US008627565B2

(12) United States Patent
Ohnuma et al.

(10) Patent No.: US 8,627,565 B2
(45) **Date of Patent: *Jan. 14, 2014**

(54) METHOD FOR PRODUCING CRANKSHAFT AND PRODUCTION APPARATUS THEREFOR

(75) Inventors: Takayuki Ohnuma, Tochigi (JP); Tsutomu Ando, Tochigi (JP); Yasuhiro Ito, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 164 days.

This patent is subject to a terminal disclaimer.

(21) Appl. No.: 13/148,402

(22) PCT Filed: Feb. 5, 2010

(86) PCT No.: PCT/JP2010/051704

§ 371 (c)(1),
(2), (4) Date: Aug. 8, 2011

(87) PCT Pub. No.: WO2010/090284

PCT Pub. Date: Aug. 12, 2010

(65) Prior Publication Data

US 2011/0308052 A1 Dec. 22, 2011

(30) Foreign Application Priority Data

Feb. 9, 2009 (JP) ..... 2009-027047
Feb. 9, 2009 (JP) ..... 2009-027050
Mar. 26, 2009 (JP) ..... 2009-075451

(51) Int. Cl.
*B21J 13/00* (2006.01)
*B21K 1/08* (2006.01)

(52) U.S. Cl.
USPC ..... 29/888.01; 29/6.01

(58) Field of Classification Search
USPC ..... 29/6.01, 888.08; 72/355.4, 355.6, 357; 74/595, 605; 164/28
See application file for complete search history.

(56) References Cited

U.S. PATENT DOCUMENTS 8,371,029 B2 * 2/2013 Ito et al. ..... 29/888.08
2010/0326235 A1 * 12/2010 Kilbon ..... 74/595
2012/0024105 A1 * 2/2012 Ohnuma et al. ..... 74/605

FOREIGN PATENT DOCUMENTS

JP 60-187436 A 9/1985
JP 61-143727 U 9/1986

(Continued)

OTHER PUBLICATIONS

Office Action, Japanese Patent Application No. 2009-027047 issued on Nov. 8, 2013.

*Primary Examiner* — Alexander P Taousakis
(74) *Attorney, Agent, or Firm* — Arent Fox LLP

(57) ABSTRACT

A preformed product of a crankshaft is formed in a shape smaller than a shape of a cavity of a separatable die set 1103 composed of an upper die and a lower die and is disposed in the cavity of the die set 1103 as a material M. The cavity of the die set 1103 matches a required shape of the crankshaft. When the material M is disposed in the cavity of the die set 1103, a clearance is formed between the material M and the cavity, and when a side-forming punch 1000P is inserted into the material M, a hollow hole is formed in the material M and the cavity is filled with the material M. As a result, not only can weight saving be achieved by forming the hole in the crankpin of the crankshaft, but also degradation of dimensional accuracy by forming the hole can be avoided.

7 Claims, 13 Drawing Sheets

(56) References Cited

FOREIGN PATENT DOCUMENTS

| | | | |
|---|---|---|---|
| JP | 4-54535 | U | 5/1992 |
| JP | 5-349 | A | 1/1993 |
| JP | 6-39235 | U | 5/1994 |
| JP | 2000-334537 | A | 12/2000 |
| JP | 2003-010940 | A | 1/2003 |
| JP | 2003-343592 | A | 12/2003 |
| JP | 2005-230907 | A | 9/2005 |
| JP | 2007-245229 | A | 9/2007 |
| JP | 2008-087048 | A | 4/2008 |

* cited by examiner

P Start-up of Operations of Cams 2111c to 2114c
Q Maximum Stroke of Cams 2111c to 2114c
R Finish of Evacuation of Cams 2111c to 2114c and Start-up of Operations of Cams 2115c to 2118c
S Bottom Dead Point, Maximum Stroke of Cams 2115c to 2118c
T Finish of Evacuation of Cams 2115c to 2118c
U Operation of Ejector pin

METHOD FOR PRODUCING CRANKSHAFT AND PRODUCTION APPARATUS THEREFOR

BACKGROUND OF THE INVENTION

1. Field of the Invention

The present invention relates to a method for producing a crankshaft having a hollow hole, and relates to a production apparatus therefor.

2. Related Art

A crankshaft of an internal-combustion engine is provided with a journal shaft. A crankpin that is parallel to the journal shaft is connected thereto via an arm. A counterweight is formed in the arm, and the forming position of the counterweight with respect to the journal shaft is at the opposite side to the connecting position of the crankpin.

In the crankshaft, from the viewpoint of improvement of fuel efficiency, weight saving by forming a hollow hole in the crankpin may be performed. When the hollow hole is formed in the crankpin, rigidity of the crankshaft is slightly affected by the forming of the hole, so that the hole is preferably formed in the crankpin. As a method for forming the hole, machining, and a method in which a crankpin is formed from a tubular material and is connected to a main body of the crankshaft, may be exemplified. In both methods, complicated steps are required, so that the production cost is higher. For reducing the production cost, forming of the main body of the crankshaft and forming the hole are effectively performed by forging. However, the crankshaft has a complicated structure as described above, so that forming the hole and the crankshaft cannot be simultaneously performed in the conventional forging.

That is, in the conventional forging, an upper die and a lower die of a die set are moved in a moving direction of a press ram so as to hold a forming object, and the material is loaded into a cavity of the closed die set, so that a required shape of the material can be obtained (for example, see Japanese Patent Application, First Publication No. 2003-343592). When a crankshaft is formed by such a forging, the crankshaft must be disposed in the die set in a condition in which the axial direction of the crankshaft is perpendicular with respect to the moving direction of the press ram, so that a punch for forming the hole cannot be inserted from the axial direction of the crankshaft into the crankpin. Therefore, in conventional forging, hot multiple processing, forming burrs, is ordinarily used. In this case, crankpins and the arms are formed in a solid condition and are provided with a draft inclination for removal from the die set so that the separatable die set composed of the upper die and the lower die can be applied thereto.

As is explained above, in forging using a die set having a closable structure, forming a hole in a crankpin is difficult, so that the hole is formed after forging and trimming in a condition in which the crankshaft is not disposed in a closed space.

Specifically, for example, when holes 1013A and 1013B are formed in a crankshaft 1010 shown in FIG. 5, as shown in FIG. 6A, one surface of one arm 1012 (the rightmost arm 1012 in FIG. 5) connecting the crankpin 1013 is abutted at a lower die 1001 (the shaded area in FIG. 6A) and a punch 1002 is inserted into the crankpin 1013 from an upper side of another arm 1012. The holes 1013A and 1013B are individually formed by insertion of the punch 1002. In forming the hole 1013B, an adjacent portion of the arm 1012 interferes with the punch 1002, so that the punch 1002 is inserted into the crankpin 1013 from an inclined direction (the direction indicated by the dashed arrowhead line in FIG. 5). In this case, a mark of abutting may remain on the portion abutting at the lower die 1001 in the one surface of the arm 1012 (the rightmost arm 1012 in FIG. 5).

However, in the method shown in FIG. 6A, as shown in FIG. 6B, the radial direction (the directions indicated by the arrows in FIG. 6B) of the crankpin 1013 is not restrained, so that dimensional accuracy of the crankpin 1013 is degraded by forming the holes 1013A and 1013B thereto. Specifically, in the crankpin 1013, shrinkages of the opening end surfaces of the holes 1013A and 1013B occur in the axial direction of the crankpin 1013 and the material thereof is extended toward the radial direction (the direction indicated by arrows in FIG. 6B). Therefore, balance of the arm 1012 must be corrected in a way such as forming plural holes (not shown) in the circumference of the counterweight of the arm 1012.

Then, using a preformed body previously formed in an applicable shape for a vertically separatable die set as a forming object, coining may be performed by a forging apparatus perpendicularly moving with respect to the moving direction of the press ram. However, improvement in dimensional accuracy in forming the hole could not be obtained by this side forming technique. This problem is a first object of the present invention.

For forming a hole in the crankpin, a forging apparatus having a side forming punch, which is moved toward the perpendicular direction with respect to the moving direction of the press ram, may be used (For example, see Japanese Patent Application, First Publication No. 2007-245229). As a driving source of the side-forming punch of the forging apparatus, a cam mechanism is ordinarily used so that the cam mechanism having a simplified structure compared to a servomotor and oil pressure means can be disposed in the inside of a die set and can linearly follow movement of the press ram.

FIG. 12 is a conceptual diagram for explanation of movement of a side-forming punch 2020 by a cam mechanism 2010. The cam mechanism 2010 is provided with a cam driver 2012 for driving cams 2011 and 2012, and a cam holder 2013 by which these members 2011 and 2012 are slidably held. A side-forming punch 2020 is provided at one side surface of the cam 2011 facing a die set and another side surface thereof on the opposite side to the die set is inclined. Furthermore, a bottom surface of the cam driver 2012 is disposed with a predetermined clearance with respect to the inclined surface of the cam 2011 in the initial condition of the cam driver 2012 and is inclined-surface slid with respect to the inclined surface of the cam 2011 in an operation of the cam 2011. In the cam mechanism 2010, when an upper plate 2031 is downwardly moved at a predetermined distance toward a lower plate 2032 by the press ram (not shown), the inclined surfaces of the cam 2011 and the cam driver 2012 contact each other. These inclined surfaces slide relative to each other by the further downward movement of the upper plate 2031, so that the side forming punch 2020 is moved toward the inside of the die set along the horizontal direction.

However, when the crankshaft is formed by this forging apparatus, the crankshaft must be disposed in the die set in a condition in which an axial direction of the crankshaft is perpendicular to the moving direction of the press ram, so that the side forming punch 2020 must be inserted into the crankpin from the axial direction of the crankshaft. Therefore, when the holes are formed in each crankpin of the crankshaft applied to a multiple-cylinder engine, the side-forming punches intersect.

Specifically, in the side-forming using the cam mechanism 2010, the cam 2011 is moved in conjunction with the movement of the press ram so that the side-forming punch 2020 provided to the cam 2011 is inserted and reaches to the deepest portion in the crankpin when the press ram reaches the bottom dead point. After this operation, the press ram is moved toward a top dead point, and the side-forming punch is pulled out from the crankpin. Therefore, for example, as shown in FIG. 13, when the hole 2044 is formed in each crankpin 2043 of the crankshaft 2040 having a full counterweight structure in a four-cylinder engine, side-forming punches 2021 and 2022 intersect each other and side-forming punches 2023 and 2024 also intersect each other (See areas framed by dashed lines in FIG. 13). Therefore, plural holes cannot be formed at the positions in which the side-forming punches intersect each other in one stroke from the top dead point to the bottom dead point of the press ram. Reference numeral 2041 indicates a journal shaft and reference numeral 2042 indicates a crank arm in FIG. 13.

For these reasons, the side-forming using the cam mechanism cannot be applied to the forging for a crankshaft having a structure in which the side-forming punches intersect each other. Therefore, this intersection may be prevented by individual control with respect to the side forming punches using a servomotor and oil pressure means that are separate from the movement of the press ram as a driving source of the side-forming punch. However, in this technique, a large space for setting a machine, such as an actuator is required, so that not only are workability and productivity degraded, but also the press equipment is larger so that a range of movement thereof is extended to the outside of the die set. This problem is a second object of the present invention.

In the conventional production of a crankshaft, when a hollow forming operation is performed, for example, a crankshaft production apparatus 3001 shown in FIG. 20 is used. The crankshaft production apparatus 3001 is provided with a transfer-type press machine 3010, a robot 3020, and a hollow forming press machine 3030. In the transfer-type press machine 3010, a main forming operation is performed with respect to a work W and the robot 2020 carries a preformed product P of the crankshaft obtained by the transfer-type press machine 3010 to the hollow forming press machine 3030, whereby the hollow forming is performed with respect to the preformed product P of the crankshaft.

In the transfer-type press machine 3010, a press ram 3012 is disposed at an upper side of a press bolster 3011 and is facing thereto. An upset die set 3021, a rough forging die set 3022, a finishing die set 3022 and a trimming die set 3024 that can be vertically divided into upper dies and lower dies are disposed between the press bolster 3011 and the press ram 3012 in order of the forming operations toward the progressing direction thereof (toward the right hand direction in FIG. 20). In these die sets, the main forming operation (upsetting, rough forging, finishing, and trimming operations) is performed with respect to the work W. The upper dies of the die sets 3021 to 3024 are moved toward the lower dies by the press ram. The lower dies of the die sets 3021 to 3024 are fixed on an upper surface of the press bolster 3011.

FIG. 21 is a top view showing a schematic structure of the crankshaft production apparatus 3001 shown in FIG. 20. Feed bars 3013 and 3014 and clamp clicks 3013A to 3013D and 3014A to 3014D shown in FIG. 21 are not shown in FIG. 20. At the front and the rear sides of the lower dies of the die sets 3021 to 3024, the feed bars 3013 and 3014 that are extended toward the forming operations progressing direction are provided. Only one punch of a hollow forming mechanism 3042 is shown in FIG. 20 for convenience.

In the first feed bar 3013, the first clamp clicks 3013A to 3013D are provided and, in the second feed bar 3014, the second clamp clicks 3014A to 3014D are provided facing the first clamp clicks 3013A to 3013D. The first clamp clicks 3013A to 3013D and the second clamp clicks 3014A to 3014D are disposed along the extending direction of the feed bars 3013 and 3014 at a predetermined interval (the interval between the die sets). The first clamp clicks 3013A to 3013D and the second clamp clicks 3014A to 3014D hold the work W and are moved by the feed bars 3013 and 3014 along the extending direction thereof. In the feed bars 3013 and 3014, the works W after the forming operations on the lower dies of each die set are held by the clamp clicks and are transferred to the next lower dies for the next forming operations (For example, see Japanese Patent Application, First Publication No. 2008-87048).

In such a transfer-type press machine 3010, as shown in FIGS. 22A to 22C, after disposing the works W1 and W2 in the die sets, operations such as die-set clamping, die-set opening, transferring the work W to the die set for the next forming operation, the die-set clamping in the next die set, and the die-set opening thereof are sequentially performed. In this case, each operation is performed by single press ram 3012, and the transfer to the next operation is performed by the feed bars 3013 and 3014.

For example, as shown in FIG. 22A, the work W1 which was subjected to finishing forming in the finishing die set 3023 is loaded into the trimming die set 3024. In the trimming die set 3024, as shown in FIG. 22B, a burr B is punched out from the work W1 and the preformed product P of the crankshaft can be obtained. Specifically, as shown in FIG. 23A, an upper die 3024A is downwardly moved toward the work W1 on a lower die 3024B, so that the burr B is punched out from the work W1 by the upper die 3024A and the burr holding die set 3024C on which the burr B of the work W1 is disposed. Thus, the preformed product P of the crankshaft can be obtained.

Next, after the preformed product P is carried to the press machine 3030 by the robot 3020, the burr B that remained on the lower die 3024B, as shown in FIG. 22C, is upwardly moved by the upward movement of the burr holding die set 3024C and is transferred to a burr conveyer 3015 in a condition in which the burr B is held by the clamp clicks 3013D and 3014D. Specifically, as shown in FIG. 23B, according to the upward movement of the upper die 3024A, the burr B is lifted by the burr holding die set 3024C of the lower die 3024B. Next, the burr B is held by the clamp clicks 3013D and 3014D and is transferred to the burr conveyer 3015 by the feed bars 3013 and 3014.

In the hollow forming press machine 3030, a hollow hole is formed in the preformed product P, so that the formed product can be obtained (the hollow forming operation). The hollow hole is formed for weight saving from the viewpoint of improvement of fuel efficiency. In this case, when the hole is formed in the crankpin, the rigidity of the crankshaft is not so decreased, so that the hole is formed in the crankpin.

In the hollow forming operation, an upper die of a die 3041 is moved downward by a press ram 3032 toward a lower die on which the preformed product P is disposed. By this operation, the preformed product P is closed in the die set 3041 and is inserted by a punch of a hollow forming mechanism 3042 from the perpendicular direction with respect to the moving direction of the press ram 3032. In such a side-forming processing, as a driving source of the punch, means such as a cam slide, an oil hydraulic cylinder, or a servomotor is used (For example, see Japanese Patent Application, First Publication No. 61-143727). In FIG. 20, reference numerals 3024L and 3041L indicate work holding cushions such as a spring, a gas cushion, or a hydraulic cushion, and reference numeral 3031 indicates a press bolster.

When the above hollow forming processing is performed, the hollow forming press machine 3030 is separately used from the transfer-type press machine 3010, so that the production cost is increased and selectivity in the layout of the machines is degraded. Therefore, unification of the transfer type press machine 3010 and the hollow forming press machine 3030 may be performed so that the main forming operation and the hollow forming operation can be sequentially performed in a single apparatus (For example, the hollow forming die set 40341 is provided at the adjacent position on the forming operations progressing direction side of the trimming die set 3024 and the feed bars 3013 and 3014 are extended toward the forming operations progressing direction, whereby the clamp clicks are provided).

However, such a unification of these machines is difficult for the following reasons. That is, in the transfer by the feed bars 3013 and 3014, a loading position of the preformed product P is determined based on a pitch (moving amount) of the feed bars 3013 and 3014 and the pitch is fixed based on an interval between the die sets. Therefore, in the transfer by the feed bars 3013 and 3014, the pitch (the moving amount) at the hollow forming part cannot be individually modified, so that accuracy in loading the preformed product P into the hollow forming die set 3041 is degraded compared to the transfer by the robot 3020 by which the loading position of the preformed product P can be modified according to the position of the die set. Furthermore, in the hollow forming die set 3041, the clearance between the cavity for forming a finally required shape and the preformed product P is very small, so that an insertion of the preformed product P into the cavity is difficult.

Furthermore, the single press ram 3012 is applied to each die set. Therefore, when adjustment of the thickness (the adjustment in the height direction) of the hole is individually performed by the modification of the shut-height in the hollow forming operation, such an adjustment in the height direction affects the other operations. As a result, selectivity of the material shape loaded in the hollow forming operation is lost. This problem is a third object of the present invention.

SUMMARY OF THE INVENTION

A first object of the present invention is to provide a method for producing a crankshaft in which not only can weight saving be obtained by forming a hole in a crankpin, but also degradation of dimensional accuracy by forming the hole can be avoided.

A second object of the present invention is to provide a crankshaft production apparatus and a production method therefor, in which plural holes can be formed at positions in which an intersection of side-forming punches occurs within one stroke of a press ram from a top dead point to a bottom dead point thereof in a case of using a cam mechanism as a driving source of the side-forming punches.

A third object of the present invention is to provide a transfer-type crankshaft production apparatus and a production method therefor in which a main forming operation and a hollow forming operation can be sequentially performed.

The present invention provides a method for producing a crankshaft of the first aspect of the invention including preforming the crankshaft provided with a crankpin, and forging the preformed product disposed in a cavity of a separatable die set composed of an upper die and a lower die; in which a shape of the preformed product of the crankshaft is formed smaller than a shape of the cavity in the performing, a hollow hole is formed in the crankpin by inserting a punch into the crankpin in the forging, thereby filling the cavity with a material of the preformed product.

In the method for producing the crankshaft of the first aspect of the invention, the preformed product of the crankshaft is forged using the separatable die set composed of the upper die and the lower die. In this case, the preformed product of the crankshaft is formed in a shape smaller than that of the cavity of the die set used in the forging. In the forging, the die set is filled with a material of the forming product by the insertion of the punch into the crankpin, so that the required shape of the crankshaft can be obtained by forging in which the shape of the cavity of the die set is set so as to coincide with the required shape of the crankshaft. As a result, not only can weight saving of the crankshaft by forming a hollow hole in the crankpin be performed, but also dimensional accuracy thereof can be improved by forging in the closed space, so that balance correction by a method such as forming plural holes in a counterweight is unnecessary.

When the hole is formed by an ordinary machining, the corner portion around the opening of the hole is formed as an edge, so that finishing operation thereof by manual work may be additionally required to avoid concentration of stress at the edge. In the method for producing the crankshaft of the present invention, the corner portion around the opening of the hole is formed in a curved shape by a deformation resistance of the material in forging, so that the conventional finishing operation is unnecessary.

The method for producing the crankshaft of the first aspect of the invention can be applied with variations in the structure. For example, in forging, the upper die can be moved in a direction to which the upper die is opened according to the forming pressure in the die set. In this aspect, when the volume of the material of the preformed product is greater than the predetermined value, the upper die can be moved in the direction to which the upper die is opened according to forming pressure in the die set, so that the final required shape of the crankshaft can be obtained in such a case.

The present invention provides a crankshaft production apparatus including a die set having a lower die, an upper die movably arranged with respect to the lower die, and plural side-forming punches perpendicularly movable with respect to a moving direction of the upper die; a press ram for closing and forming a material of the crankshaft in the die set by moving the upper die with respect to the lower die; a cam mechanism equipped to each side-forming punch for moving the side-forming punch toward an inside of the die set in conjunction with the movement of the press ram; an evacuating mechanism equipped to at least one of the side-forming punches for avoiding interference between the side forming punches and for canceling engagement between the movements of the press ram and the side forming punch via the cam mechanism.

In the crankshaft production apparatus of the second aspect of the invention, the material of the crankshaft is closed and formed in the die set by the movement of the press ram. Furthermore, the holes are formed at predetermined positions of the material by the movements of the side forming punches toward the inside of the die set, which are caused by the cam mechanism in conjunction with the movement of the press ram.

In this condition, the evacuating mechanism is provided to at least one of the side-forming punches to avoid interference between the side-forming punches with each other and for canceling the engagement between the movement of the press ram and the movement of the side-forming punch via the cam mechanism. Therefore, after the holes are formed by the movement of one of the side-forming punches toward the inside of the die set by the cam mechanism in conjunction with the movement of the press ram, the side-forming punch is moved toward the outward direction of the die set and can be moved back to an initial position thereof in a way such that the engagement between the side-forming punch and the movement of the press ram are cancelled by the evacuating mechanism. Another side-forming punch can be started to move toward the inside of the die set by the cam mechanism in conjunction with the movement of the press ram, so that the hollow hole can be formed by another side-forming punch without interference with one of the side-forming punches.

Specifically, when the number of the side-forming punches disposed at the positions in which interference between the side forming punches occurs is N (>2), the above technique for avoiding interference is applied as follows. The operation in the technique can be sequentially performed in order of movement of a first side-forming punch into the inside of the die set, evacuation of the first side-forming punch toward the outside of the die set, movement of a second side-forming punch into the inside of the die set, evacuation of the second side-forming punch toward the outside of the die set, a movement of a (N−1) side-forming punch into the inside of the die set, an evacuation of the (N−1) side-forming punch toward the outside of the die set and movement of an Nth side-forming punch into the inside of the die set.

By using the above technique for avoiding interference, time-difference forming of plural holes in one operation of press ram from the top dead point to the bottom dead point thereof can be performed, so that the load for forming plural holes can be reduced to about half compared to the case in which the plural holes are simultaneously formed. As a result, the press equipment can be reduced in size. As explained above, the cam mechanism that can be contained in the die set can be used as a driving source of the side-forming punch, so that a space for equipping an external device, such as an actuator for an individual control of the side-forming punches, is unnecessary. Therefore, the press equipment can be further reduced in size, and workability and productivity can be improved. Furthermore, a range of the movement of the side-forming punch can be restricted in the die set, so that there is no problem in operator safety.

A method for producing a crankshaft of the second aspect of the invention includes a technique for side forming of plural holes by the crankshaft production apparatus in accordance with a second aspect of the present invention. That is, a method for producing the crankshaft in accordance with the second aspect of the present invention includes providing a die set having a lower die, an upper die movably arranged with respect to the lower die, and plural side-forming punches perpendicularly movable with respect to a moving direction of the upper die; forming a material of the crankshaft closed in the die set by a movement of a press ram, and forming holes in predetermined positions of the material by movement of each side-forming punch via a cam mechanism toward an inside of the die set in conjunction with the movement of the press ram, in which the material having a structure causing intersection of the side-forming punches with each other is used in forming the hole in the material by the side-forming punches, and one side-forming punch is evacuated by the evacuating mechanism for canceling engagement between the movement the press ram and the one side-forming punch and for avoiding the interference between the side-forming punches with each other after forming the holes, and another side-forming punch is moved toward the inside of the die set.

In the method for producing the crankshaft of the second aspect of the invention, similar effects as in the crankshaft production apparatus using the means for avoiding interference of the second aspect of the invention can be obtained.

A crankshaft production apparatus of the third aspect of the invention includes a first vertically separatable die set composed of an upper die and a lower die for preforming a material of the crankshaft; a second vertically separatable die set composed of an upper die and a lower die in which the preformed product obtained by the first vertically separatable die set is closed and is formed with a hollow hole by inserting a punch into a predetermined portion of the preformed product; a press ram closing the first vertically separatable die set and the second vertically separatable die set by the movement of the upper dies of the first vertically separatable die set and the second vertically separatable die set toward the lower dies thereof; a shim provided to the second vertically separatable die set for adjusting a position in a horizontal direction thereof; and a liner portion provided to the second vertically separatable die set for adjusting a position in a height direction thereof.

In the crankshaft production apparatus of the third aspect of the invention, the shim is provided to the second vertically separatable die set for adjusting the horizontal position thereof, so that the horizontal position of the second vertically separatable die set can be adjusted by the shim according to the loading position of the preformed product into the second vertically separatable die set. Such an adjustment of the horizontal position can be individually performed from the first vertically separatable die set, so that the adjustment does not affect the operation in the first vertically separatable die set. Therefore, not only can works (the material of the crankshaft, the preformed product and the formed product) be transferred by feed bars of which pitches are fixed based on the interval between die sets, but also the preformed product can be easily inserted into the cavity of the second vertically separatable die set even in a case in which the clearance between a cavity surface of the second vertically separatable die set and the preformed product is very slight.

Furthermore, in the second vertically separatable die set, the liner portion is provided for adjusting the height position thereof, so that a thickness adjustment (the adjustment in a height direction) of the hole required in forming the hole in the second vertically separatable die set can be taken care of by the height adjustment of the second vertically separatable die set by the liner portion. This height adjustment can be individually performed from the first vertically separatable die set, so that the adjustment does not affect the preforming operation in the first vertically separatable die set. Therefore, not only can the upper dies of the first vertically separatable die set and the second vertically separatable die set be moved toward the lower dies thereof by a single press ram, but also selectivity of the material shape loaded into the second vertically separatable die set can be improved.

Furthermore, in the crankshaft production apparatus of the third aspect of the invention explained above, when the main forming operation containing upsetting, rough forging, finishing, and trimming is performed in the first vertically separatable die set, and the hollow forming operation is performed in the second vertically separatable die set, these forming operations can be sequentially performed by the fixed-pitch feed bars and single press ram. A transfer type press apparatus having such a structure can be constructed, so that the cost can be reduced and selectivity of the layout of the equipments in the apparatus can be upgraded.

The crankshaft production apparatus of the third aspect of the invention can be applied with variations of the structure. For example, a burr-ejecting portion for ejecting a burr formed in forming the preformed product by the first vertically separatable die set can be applied to the crankshaft production apparatus of the third aspect of the invention. The burr-ejecting portion can be provided with a burr stage provided at a position between the first vertically separatable die set and the second vertically separatable die set and a burr ejecting portion for ejecting the burr provided in a direction different from the direction from the burr stage toward the second vertically separatable die set.

In the conventional technique, for example, when the hollow forming die set 3041 is adjacently provided at the forming progressing direction side of the trimming die set 3024 shown in FIG. 20, and the feed bars 3013 and 3014 are extended toward the forming progressing direction for additional providing of the clamp clicks thereon, the hollow forming die set 3041 includes a hollow forming mechanism 3042 (composed of punches and a driving source), so that a burr holding mechanism (composed of a burr holding die set 3024C and a burr pressing member 3024D) of the trimming die set 3024 shown in FIGS. 23A and 23B cannot be provided at the forming progressing direction side of the trimming die set 3024. Therefore, the burr B may be directly conveyed toward the outside of the forming progressing direction by the clamp clicks of the feed bars 3013 and 3014 shown in FIG. 21, avoiding the hollow forming die set 3041, and the interval between the clamp clicks is fixed based on the interval between the die sets, so that this specific transfer by the feed bars 3013 and 3014 cannot be modified.

On the other hand, in the above aspect, after the transfer of the preformed product from the first vertically separatable die set, the burr formed in forming the preformed product can be transferred to the burr stage of the burr ejecting portion and can be ejected from the burr ejecting portion of the burr ejecting portion toward the direction different from the direction toward the second vertically separatable die set. In this case, the clamp clicks are particularly provided at the positions on the feed bars corresponding to the work, so that not only a transference of the work, but also a transference of the burr to the burr stage of the burr-ejecting portion, can be performed by the feed bars. In this aspect, the modification of the conventional specifications, such as the interval between the clamp clicks, is unnecessary.

At the front side of the apparatus, a shutter of the apparatus is ordinarily provided, so that the burr-ejecting portion may be disposed at the position between the burr stage and the shutter. In this case, distance between the shutter and the die sets for each forming operation is increased, so that workability of the operator of the apparatus is degraded. Therefore, the burr-ejecting portion is preferably disposed at the rear side of the apparatus. Ordinarily, at the rear side thereof, a coating apparatus for applying a separating compound to the die set is disposed. In this aspect, the burr-ejecting portion can be disposed below the coating apparatus, avoiding the coating apparatus.

A method for producing the crankshaft of the third aspect of the invention includes a technique in which the main forming operation in the first vertically separatable die set and the hollow forming operation in the second vertically separatable die set are sequentially performed by the crankshaft production apparatus of the present invention using the single press ram and transfer by the feed bar.

The method for producing a crankshaft of the third aspect of the invention includes preforming a material of the crankshaft closing the material in a first separatable die set, and forming a hole by closing a preformed product in a second separatable die set and inserting a punch provided to the second separatable die set into the predetermined portion of the preformed product, in which a first vertically separatable die set and a second vertically separatable die set are closed by moving the upper dies of the first separable die set and the second separatable die set toward the lower dies thereof by a press ram; a position in a horizontal direction of the second separatable die set is adjusted by a shim and a position in a height direction of the second separatable die set is adjusted by a liner portion.

In the method for producing the crankshaft of the third aspect of the invention, effects similar to those of the crankshaft production apparatus of the third aspect of the invention can be obtained.

According to the method for producing the crankshaft of the first aspect of the invention, not only weight saving, but also an effect such as avoiding degradation of dimensional accuracy by forming the hole, can be obtained.

According to the crankshaft production apparatus and the production method of the second aspect of the invention, even though the cam mechanism is used as the driving source of the side forming punch, the plural holes can be formed with time-difference within one operation of the press ram from the top dead point to the bottom dead point thereof. Therefore, an effect such as reduction in size of the press equipment can be obtained.

According to the crankshaft production apparatus and the production method of the third aspect of the invention, when the main forming operation containing upsetting, rough forging, finishing, and trimming is performed in the first vertically dividing die set and the hollow forming step is performed in the second vertically separatable die set, an effect such that these forming operations can be sequentially performed by the fixed-pitch feed bars and single press ram can be obtained.

BRIEF DESCRIPTION OF DRAWINGS

FIG. 8A is a cross-sectional side view showing the structure taken along a line 8A to 8A' in FIG. 7, and FIG. 8B is a cross-sectional side view showing the structure taken along a line 8B to 8B' in FIG. 7.

DESCRIPTION OF PREFERRED EMBODIMENTS

1. First Embodiment

Figure 1:
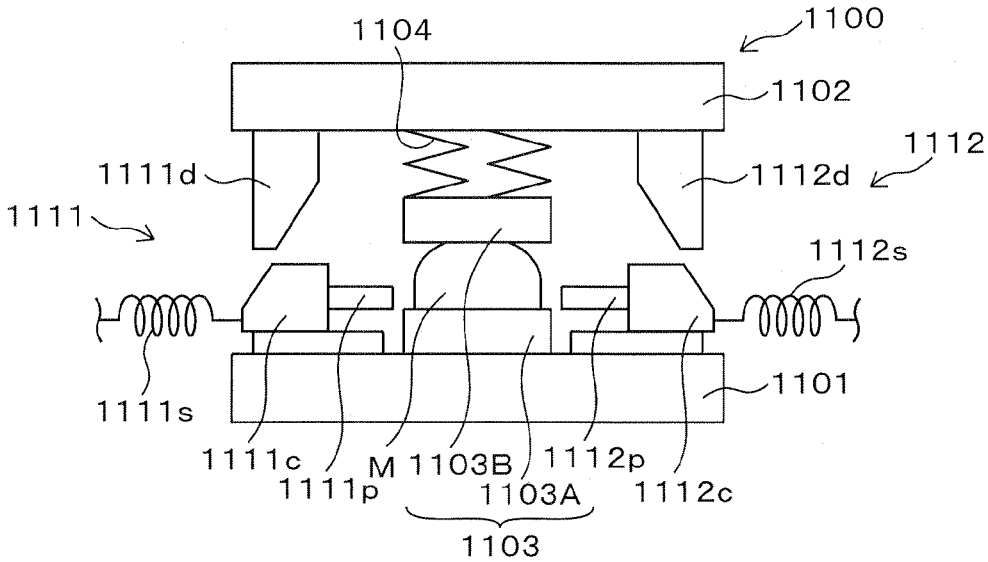
FIG. 1 is a conceptual diagram for an explanation of a movement of a forging apparatus used in a method for producing a crankshaft in accordance with an embodiment of a first aspect of the invention.

An embodiment of the first aspect of the invention is explained with reference to Figures hereinafter. FIG. 1 is a conceptual diagram for an explanation of movement of a forging apparatus 1100 used in a method for producing a crankshaft of the first embodiment. In FIG. 1, each portion of the forging apparatus 1100 (especially a die set 1103) is simply shown.

In the forging apparatus 1100, for example, a press bolster 1101 is provided thereto and a press ram 1102 is held above the press bolster 1101. A die set 1103 is disposed between the press bolster 1101 and the press ram 1102.

The die set 1103 is provided with a lower die 1103A, an upper die 1103B and side-forming punches 1111*p* and 1112*p*. The upper die 1103B is movably arranged with respect to the lower die 1103A. Reference numeral 1104 in FIG. 1 is a load-adjusting portion (an oil or an air pressure means) for adjusting the initial load with respect to the upper die 1103B. A material M is disposed in the die set 1103. When the volume of the material M is greater than a predetermined value, the upper die 1103B is moved toward an opening direction (an upward direction) according to the forming pressure in the die set 1103.

The side-forming punches 1111*p* and 1112*p* are movably provided toward the perpendicular direction with respect to the moving direction of the upper die 1103B. The side-forming punches 1111*p* and 1112*p* can be inserted into the die set 1103 and can be pulled out therefrom through a punching hole (not shown) formed in a side portion of the die set 1013. The side-forming punches 1111*p* and 1112*p* are provided with cam mechanisms 1111 and 1112 by which the side-forming punches 1111*p* and 1112*p* are moved into the die set 1103 in conjunction with the movement of the press ram. The cam mechanisms 1111 and 1112 are provided with cams 1111*c* and 1112*c* and cam drivers 1111*d* and 1112*d* for driving the cams 1111*c* and 1112*c*.

The side-forming punches 1111*p* and 1112*p* are provided at each one side surface, which faces the die set 1103, of cams 1111*c* and 1112*c*. Other side surfaces of the cams 1111*c* and 1112*c*, which face the opposite sides to the die set 1103, are inclined. The bottom surfaces of the cam drivers 1111*d* and 1112*d* are inclined surfaces which are disposed via a predetermined interval with respect to the inclined surfaces of the cams 1111*c* and 1112*c* in the initial condition of the cam drivers. The cam drivers 1111*d* and 1112*d* are downwardly moved according to a downward movement of the press ram 1102 and the bottom surfaces of the cam drivers 1111*d* and 1112*d* contact to the inclined surfaces of the cams 1111*c* and 1112*c*, whereby these surfaces thereof slide relative to each other.

The cam mechanisms 1111 and 1112 are provided with evacuating members 1111*s* and 1112*s*. After finishing the side-forming by the side-forming punches 1111*p* and 1112*p* when the press ram is disposed at the bottom dead point thereof; the cam drivers 1111*d* and 1112*d* are moved upward according to the upward movement of the press ram toward the top dead point, so that the side-forming punches 1111*p* and 1112*p* are evacuated toward the outside of the die set 1103 by the evacuating members 1111*s* and 1112*s* and are moved back to the initial positions thereof.

When a preformed product of the crankshaft processed by trimming for forming is disposed in this forging apparatus 1100 as a material M, an axial direction of a journal shaft is perpendicularly set with respect to the moving direction of the press ram. In this case, a crankpin is disposed in a parallel direction with respect to the journal shaft, so that one surface of the crankpin (the perpendicular surface with respect to the journal shaft) faces the side-forming punches 1111*p* and 1112*p*. The preformed product of the crankshaft is formed in a shape smaller than a required shape of the crankshaft and a shape of a cavity of the die set 1103 is set so as to coincide with the required shape of the crankshaft.

Figure 2:
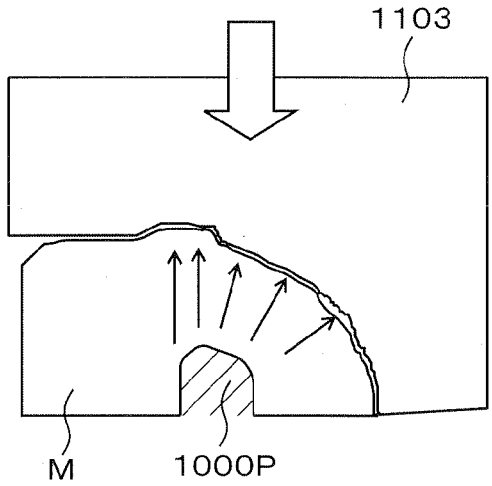
FIG. 2 is a conceptual diagram for an explanation of a method for producing the crankshaft in accordance with the embodiment of the first aspect of the invention.

A method for producing the crankshaft of the first embodiment using the forging apparatus 1100 is explained referring to FIGS. 1 and 2.

First, as a material M, a preformed product of the crankshaft is disposed in the cavity of the die set 1103. Next, when the press ram 1102 is initiated, a downward moving thereof from the top dead point toward the lower direction, the cam drivers 1111*d* and 1112*d* are downwardly moved according to the downward movement of the press ram 1102, so that the inclined surfaces of the cam drivers 1111*d* and 1112*d* contact the inclined surfaces of the cams 1111*c* and 1112*c*. These inclined surfaces slide relative to each other by the further downward movement of the press ram 1102, so that the side-forming punches 1111*p* and 1112*p* are moved into the inside of the die set 1103 along the horizontal direction. Thus, holes are formed in the crankpin of the preformed product by the side-forming punches 1111*p* and 1112*p*.

Next, when the press ram reaches the bottom dead point, stroke lengths of the cams 1111*c* and 1112*c* are maximum and the side-forming by the side-forming punches 1111*p* and 1112*p* is finished. Next, when the cam drivers 1111*d* and 1112*d* start moving upward according to the upward movement of the press ram 1102, the cams 1111*c* and 1112*c* are evacuated toward the opposite side to the die set 1103 by the evacuating members 1111*s* and 1112*s*. After the cans 1111*c* and 1112*c* are moved back to their initial positions, the crankshaft in which the holes are formed is removed from the die set by action of an ejector pin.

In such a forging of the first embodiment, when the preformed product is used as a material M, the preformed product, which is formed in a shape smaller than the required shape (that is, the shape of the cavity of the die set 1103) of the crankshaft, is disposed in the cavity of the die set 1103.

The side-forming punches 1111*p* and 1112*p* are inserted into the crankpin of the preformed product, so that the holes can be formed in the crankpin and the die set 1103 can be filled with the material of the preformed product. FIG. 2 is a conceptual diagram for explanation of a method for producing the crankshaft of the first embodiment and the case of forming the hole by one side-forming punch 1000*p* is shown in FIG. 2. In FIG. 2, a downward arrowhead indicates a direction of a confining pressure of the die set 1103 with respect to the material M and the upward arrowed lines in FIG. 2 indicate the loading direction of the material M. As shown in FIG. 2, when the material M formed in a shape smaller than that of the cavity is disposed in the cavity of the die set 1103, even though clearances are formed between the material M and the cavity, the clearances can be filled with the material by the insertion of the side-forming punch 1000*p* into the material M.

As explained in the above, in the forging of the first embodiment, the cavity of the die set 1103 can be filled with the material, so that the required shape of the crankshaft can be obtained by the forging in a way such that the shape of the cavity of the die set 1103 is set so as to coincide with the required shape of the crankshaft. As a result, in the crankshaft, not only can weight saving be obtained by forming the hole in the crankpin, but also dimensional accuracy of the crankshaft can be improved by the forging in this closed space, so that balance correction such as forming plural holes in a counterweight is unnecessary. Furthermore, an edge portion around an opening of the hole is curved by a deformation resistance in forging of the material, so that conventional finishing operation is also unnecessary.

In particular, when the volume of the material of the preformed product is longer than the predetermined value thereof, the upper die 1103B can be moved toward the opening direction according to the forming pressure in the die set 1103, so that the required shape of the crankshaft can be obtained in this case.

2. Second Embodiment

2-1. Structure in Second Embodiment

Figure 7:
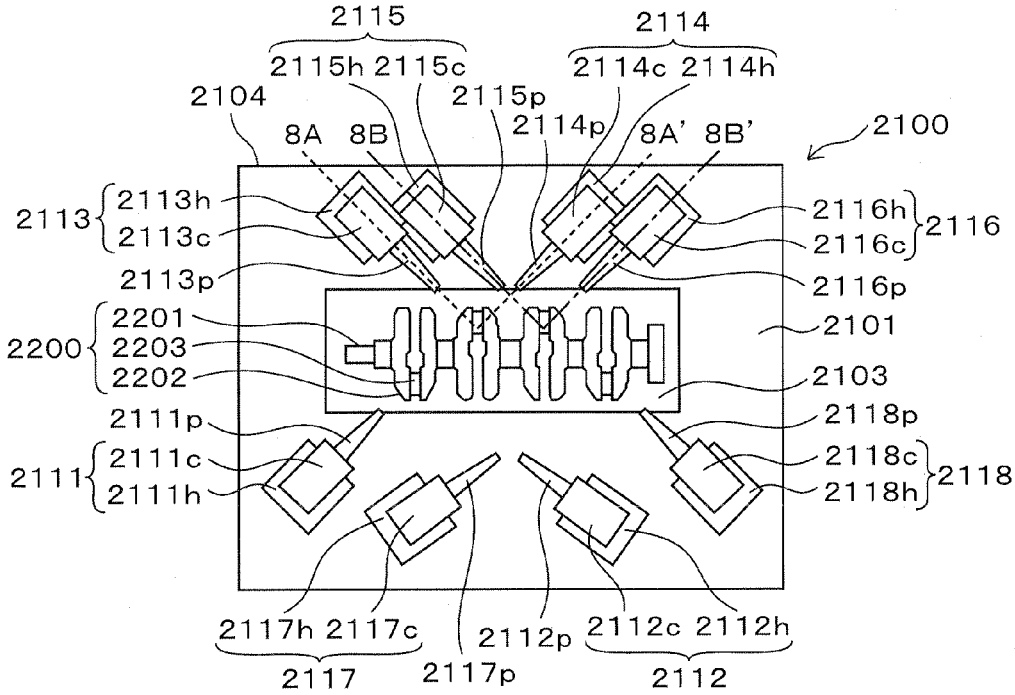
FIG. 7 is a top view showing a schematic structure of a crankshaft production apparatus in accordance with an embodiment of a second aspect of the invention.
Figure 8A:
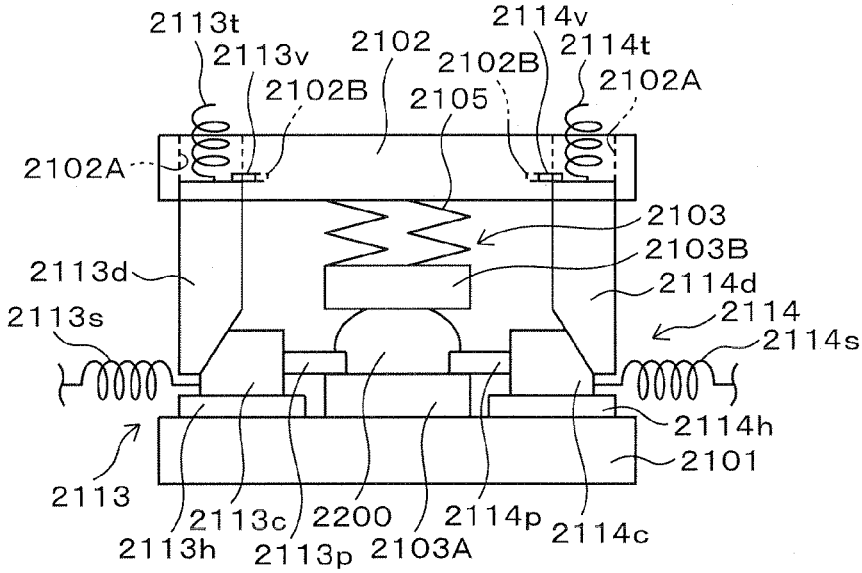
FIGS. 8A and 8B are views showing schematic structures of the crankshaft production apparatus in accordance with the embodiment of the second aspect of the invention.
Figure 8B:
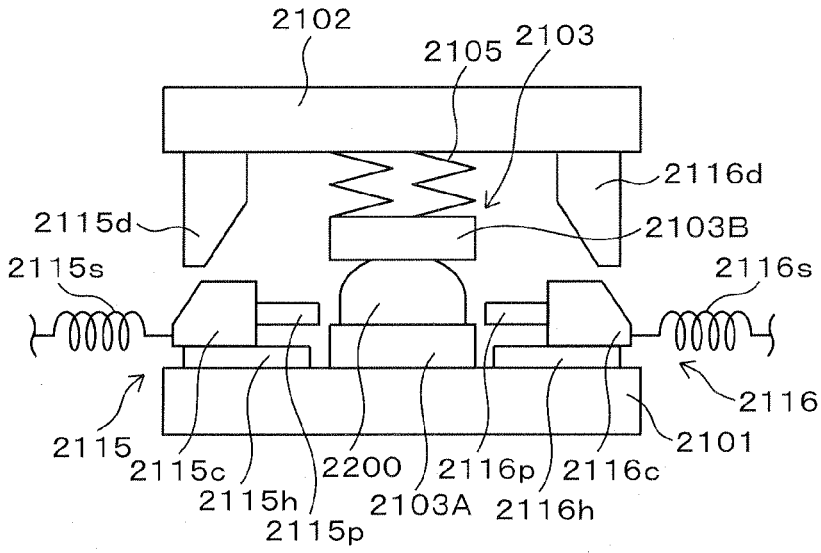

An embodiment of the second aspect of the invention (the second embodiment) is explained referring to Figs. FIG. 7 and FIGS. 8A and 8B are views showing schematic structures of a crankshaft production apparatus 2100. FIG. 7 is a schematic top view showing the total structure of the crankshaft production apparatus 2100, FIG. 8A is a schematic cross-sectional side view showing a structure taken along a line 8A to 8A' in FIG. 7, and FIG. 8B is a schematic cross-sectional side view showing a structure taken along a line 8B to 8B' in FIG. 7. In FIG. 7 and FIGS. 8A and 8B, for convenience of showing views, omission and simplification in views of each portion are made. Specifically, a press ram 2104 and a load adjusting portion 2105 are omitted in FIG. 7, an upper die 2103A and a lower die 2103B of a die set 2103 and cam holders 2113*h* to 2116*h* are simply shown in FIGS. 8A and 8B. For the convenience of showing views, relative positions of the side-forming punches 2111*p* to 2118*p* and the cam mechanisms 2111 to 2118 are not exactly shown in FIG. 7.

The crankshaft production apparatus 2100 is provided with, for example, a press bolster 2101, and the press ram 2102 is held above the press bolster 2101. The die set 2103 is disposed between the press bolster 2101 and the press ram 2102. Reference numeral 2104 in FIG. 7 shows one surface of a bed on which the press bolster 2101 is disposed.

The die set 2103 is provided with the lower die 2103A, the upper die 2103B and the side-forming punches 2111*p* to 2118*p*. A preformed product 2200 is disposed in the die set 2103. The preformed product 2200 is provided with a journal shaft 2201 and an arm 2202 is provided to the journal shaft 2201. The adjacent arms 2202 are connected to each other via a crankpin 2203 disposed in the parallel direction with respect to the journal shaft 2201. The crankpin 2203 is disposed in the parallel direction with respect to the journal shaft 2201. A cavity surface of the die set 2103 has a shape coinciding with the shape of the preformed product 2200. The upper die 2103B is movably provided with respect to the lower die 2103A. Reference numeral 2105 is a load-adjusting portion (the portion driven by oil or air pressure means) for adjusting the initial load with respect to the upper die 2103B.

The side forming punches 2111*p* to 2118*p* are movably provided in the perpendicular direction with respect to moving direction of the upper die 2103B. The side-forming punches 2111*p* to 2118*p* can be inserted into the inside of the die set 2103 and can be removed therefrom through punching holes (not shown) formed in the side portions of the die set 2103.

The side forming punches 2111*p* to 2118*p* are provided to the cam mechanisms 2111 to 2118 for moving the side-forming punches 2111*p* to 2118*p* into the die set 2103 in conjunction with the movement of the press ram 2102. The cam mechanisms 2111 to 2118 are provided with the cams 2111*c* to 2118*c*, the cam drivers for driving the cams and cam holders 2111*h* to 2118*h* by which the cams and the cam drivers are slidably held.

The side-forming punches 2111*p* to 2118*p* are provided at side surfaces of the cams 2111*c* to 2118*c* facing the die set 2103. Other side surfaces of the cams 2111*c* to 2118*c*, which are on the side opposite to the die set 2103 are inclined surfaces. The bottom surfaces of the cam drivers are inclined surfaces sliding with respect to the inclined surfaces of the cams 2111*c* to 2118*c*. In the cam mechanisms 2111 to 2118, when the upper die 2103B is moved downward by the press ram 2102, the inclined surfaces of the cam drivers and those of the cams 2111*c* to 2118*c* contact each other. These inclined surfaces slide relative to each other by the further downward movement of the press ram 2102, so that the side forming punches 2111*p* to 2118*p* are moved into the inside of the die set 2103 along the horizontal direction.

The cam drivers of the cam mechanisms 2111 to 2114 are disposed so as to be perpendicularly movable via passing through holes 2102A of the press ram 2102. In this case, each cam driver is held in the passing through hole 2102A by holding members described below until finishing of the forming by the side-forming punches corresponding to the cam drivers. In this case, the holding positions of the cam drivers with respect to the inclined surfaces of the cams are set above the holding positions of the cam of the cam mechanisms 2111 to 2114 with a predetermined distance therefrom. The cam drivers 2113*d* and 2114*d* of the cam mechanisms 2113 and 2114 and holding members 2113*v* and 2114*v* are shown in FIG. 8A. Furthermore, the cam mechanisms 2111 and 2112 are provided with the cam drivers and the holding members having the same structures as those of the cam mechanisms 2113 and 2114. The cam drivers 2115*d* and 2116*d* of the cam mechanisms 2115 and 2116 are shown in FIG. 8B and the cam mechanisms 2117 and 2118 are provided with the cam drivers having the same structure as the cam drives of the cam mechanisms 2115 and 2116.

In the cam mechanisms 2111 to 2114, the cam evacuating mechanisms are provided for evacuating the side forming punches 2111*p* to 2114*p* toward the outside of the die set 2103 after finishing the side forming on the way from the top dead point to the bottom dead point of the press ram 2102. The cam evacuating mechanisms are provided with first evacuating members, second evacuating members and the holding members described in the above. The first evacuating members are elastic members formed at, for example, the side surfaces of the cams 2111*c* to 2114*c* on the side opposite to the die set 2103. The second evacuating members are elastic members formed on, for example, the upper surface of the cam drivers. The holding members are moved from the position on the upper surfaces of the cam drivers into evacuating holes 2102B for canceling the engagements between the press ram 2102 and the cams 2111*c* to 2114*c* after finishing the forming of the side forming punches 2111*p* to 2114*p*. When the holding members are moved into the evacuating holes 2102B of the press ram 2102, the cam drivers are moved upward by the second evacuating members, so that the cams are evacuated toward the side opposite to the die set 2103 by the first evacuating members. The first elastic members 2113*s* and 2114*s* of the cam mechanisms 2113 and 2114 and the second elastic members 2113*t* and 2114*t* are shown in FIG. 8A, and the cam mechanisms 2111 and 2112 are provided with the first elastic members and the second elastic members having the same structures as the first and second elastic members of the cam mechanisms 2113 and 2114.

In the cam mechanisms 2115 to 2118, the cam evacuating mechanisms are provided for evacuating the side forming punches 2115*p* to 2118*p* from the die set 2103 toward the outside thereof after finishing the side forming when the press ram 2102 is positioned at the bottom dead point thereof. The cam evacuating mechanisms are provided with the first evacuating members. The first evacuating members 2115*s* and 2116*s* of the cam mechanisms 2115 and 2116 are shown in FIG. 8B, and the cam mechanisms 2117 and 2118 are provided with the first evacuating members having the same structures as the first evacuating members of the cam mechanisms 2115 and 2116.

In providing the preformed product 2200 to, for example, a small or a medium emission volume engine, when the preformed product 2200 is heated to a high temperature (for example, 1000 to 1200° C.), a load acting on the die set 2103 by which the preformed product 2200 can be held avoiding deformation thereof in forming the holes is, for example, about 400 tons. A load in forming the hole is, for example, about 100 tons depending on a shape and a cross-sectional area thereof, because the way of processing is forging. Therefore, in the crankshaft production apparatus 2100, press working of about a 1200-ton load as a total load for forming is required. The die set 2103 and the cam mechanisms 2111 to 2118 are disposed and held in the die set for the press working in the above conditions.

2-2. Movement of Second Embodiment

Figure 9:
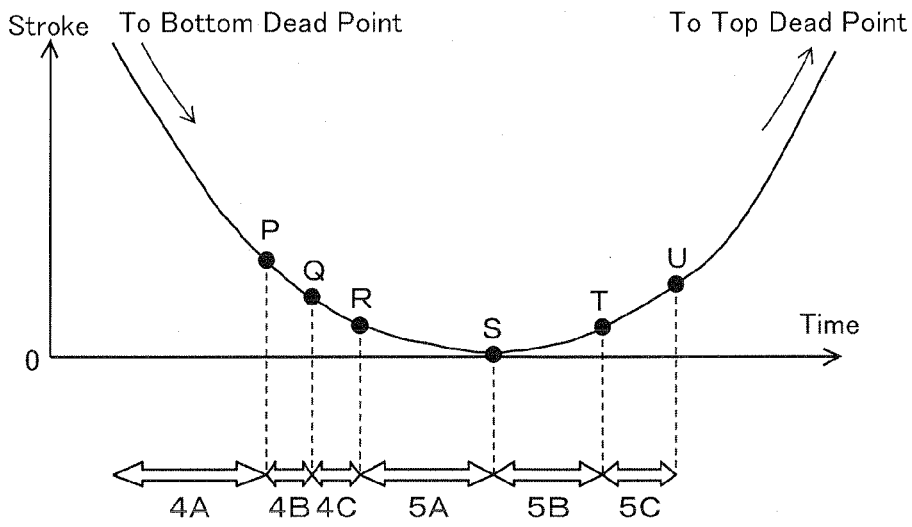
FIG. 9 is a graph showing a time dependence of a stroke of a press ram in the crankshaft production apparatus in FIG. 7 and FIGS. 8A and 8B, which explains movements of the side forming punches in transition of the stroke.

Movement of a crankshaft production apparatus 2100 is explained with principal reference to FIG. 9, FIGS. 10A to 10C, and FIGS. 11A to 11C. FIG. 9 is a graph showing a time dependence of a stroke of a press ram 2102 of the crankshaft production apparatus 2100 shown in FIG. 7 and FIGS. 8A and 8B, and the graph is for an explanation of each movement of the side-forming punches 2111*p* to 2118*p* in varying the stroke of the press ram 2102. FIGS. 10A to 10C, and FIGS. 11A to 11C, are schematic top views showing each movement of the side-forming punch 2111*p* to 2118*p* in varying the stroke of the press rams 2102 shown in FIG. 9. In the second embodiment, the movements of the side-forming punches 2113*p* and 2114*p* using the cam mechanisms 2113 and 2114 are the same as the movements of the side-forming punches 2111*p* and 2112*p* using the cam mechanisms 2111 and 2112. Furthermore, the movements of the side-forming punches 2115*p* and 2116*p* using the cam mechanisms 2115 and 2116 are the same as the movements of the side-forming punches 2117*p* and 2118*p* using the cam mechanisms 2117 and 2118. Therefore, in the following explanation, the movements of the side-forming punches 2111*p*, 2112*p*, 2117*p* and 2118*p* are mainly explained.

Figure 10A:
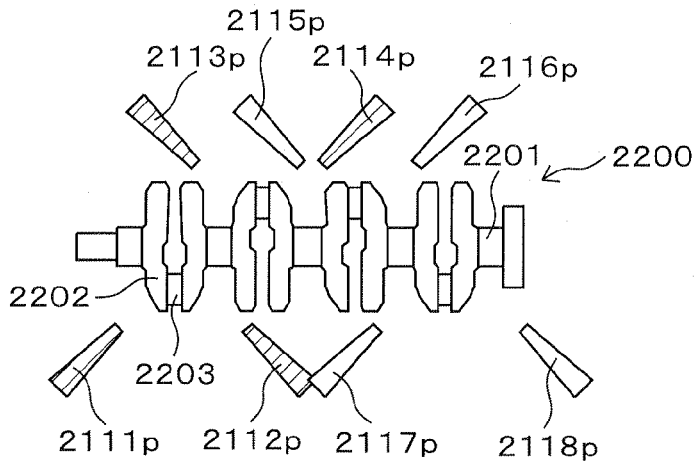
FIGS. 10A to 10C are top views showing movements of each side forming punch in transition of the stroke of the press rams shown in FIG. 9.

First, the preformed product 2200 is disposed in a die set 2103. As shown in FIG. 10A, the side-forming punches 2111*p* to 2118*p* are held at the outside of the die set 2103 in the initial conditions thereof (the condition of reference symbol 4A in FIG. 9). Next, the cam drivers of the cam mechanisms 2111 to 2118 are moved downward according to a downward movement of the press ram 2102 from the top dead point toward the downward direction.

Figure 10B:
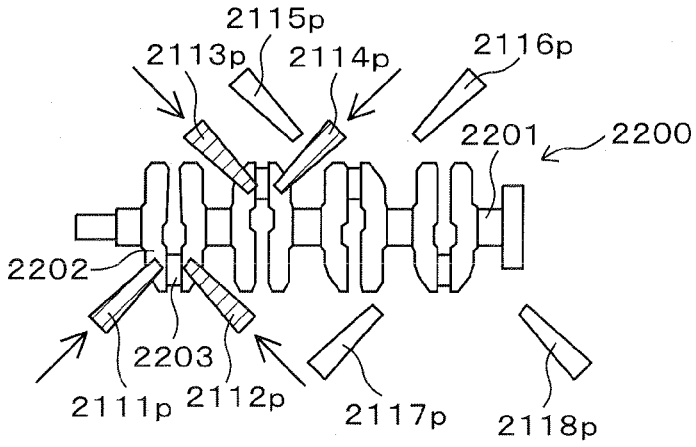

By this movement, in the cam mechanisms 2111 to 2114, the inclined surfaces of the cam drivers (in the cam mechanisms 2113 and 2114, reference symbols 2113*d* and 2114*d* in FIG. 8A) contact the inclined surfaces of the cams 2111*c* to 21114*c*. These sliding surfaces slide relative to each other (the point of reference symbol P in FIG. 9) by the further downward movement of the press ram 2102, so that, as shown in FIG. 10B, the side-forming punches 2111*p* to 2114*p* are moved into the inside of the die set 2103 along the horizontal direction. Therefore, the crankpin 2203 of the preformed product 2200 is processed by side-forming of the side-forming punches 2111 to 2114, whereby the holes 2211 to 2214 are formed (the condition of reference symbol 4B in FIG. 9). At this time, the inclined surfaces of the cam drivers of the cam mechanisms 2115 to 2118 (reference symbols 2115*d* and 2116*d* of the cam mechanisms 2115 and 2116 in FIG. 8B) are upwardly positioned compared to the cam drivers of the cam mechanisms 2111 to 2114, and are detached to the inclined surfaces of the cams 2115*c* to 2118*c*.

Figure 10C:
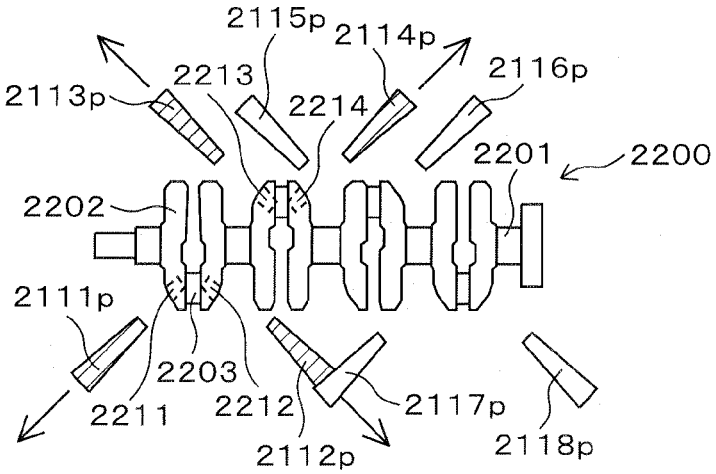

Next, the stroke lengths of the cams 2111*c* to 2114*c* become longest (the point of reference symbol Q in FIG. 9) and forming the holes 2211 to 2214 by the side-forming punches 2111*p* to 2114*p* is finished. Furthermore, the holding members (in the cam mechanisms 2113 and 2114, reference symbols 2113*v* and 2114*v* in FIG. 8A) holding the upper surfaces of the cam drivers are moved into evacuating holes 2102E of the press ram 2102, so that the engagement between the press ram 2102 and the cams 2111*c* to 2114*c* is cancelled. Then, the cam drivers are moved upward through the through holes 2102A by the second evacuating members (in the cam mechanisms 2113 and 2114, reference symbols 2113*t* and 2114*t* in FIG. 8A), and, as shown in FIG. 10C, the cams 2111*c* to 2114*c* are evacuated toward the outside of the die set 2103 by the first evacuating members (the condition of reference symbol 4C in FIG. 9).

Figure 11A:
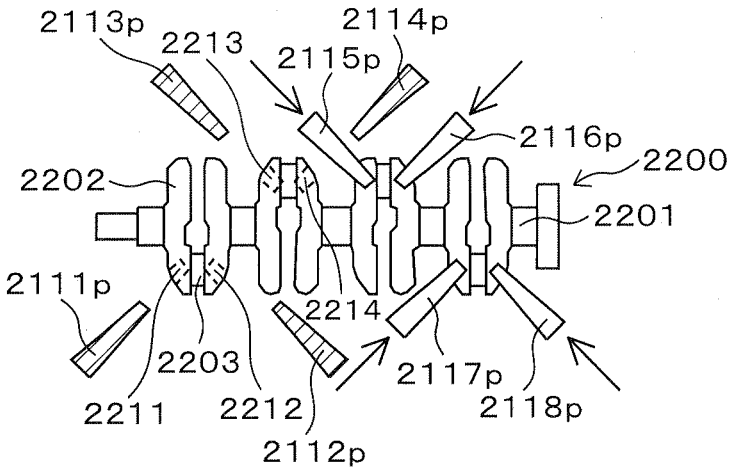
FIGS. 11A to 11C are top views showing movements of each side forming punch continuing from FIGS. 10A to 10C.

Next, when the cams 2111*c* to 2114*c* are moved back to their initial positions, in the cam mechanisms 2115 to 2118, the inclined surfaces of the cam drivers (in the cam mechanisms 2115 and 2116, reference symbols 2115*d* and 2116*d* in FIG. 8B) simultaneously contact the inclined surfaces of the cams 2115*c* to 2118*c*. When the downward movement of the press ram 2102 is further performed, these inclined surfaces slide relative to each other (the point of reference symbol R in FIG. 9), as shown in FIG. 11A, the side-forming punches 2115*p* to 2118*p* are moved into the inside of the die set 2103 along the horizontal direction. By this movement, side-forming with respect to the crankpin 2203 of the preformed product 2200 is performed by the side-forming punches 2115*p* to 2118*p*, so that the holes 2215 to 2218 are formed (the condition of reference symbol 5A in FIG. 9).

Figure 11B:
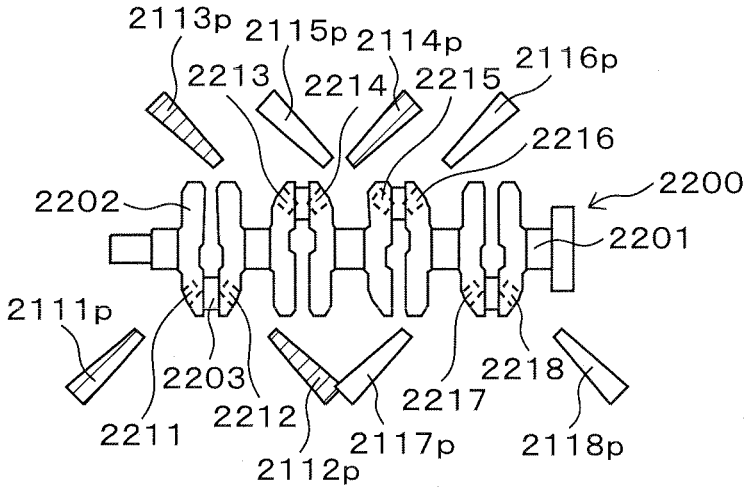
Figure 11C:
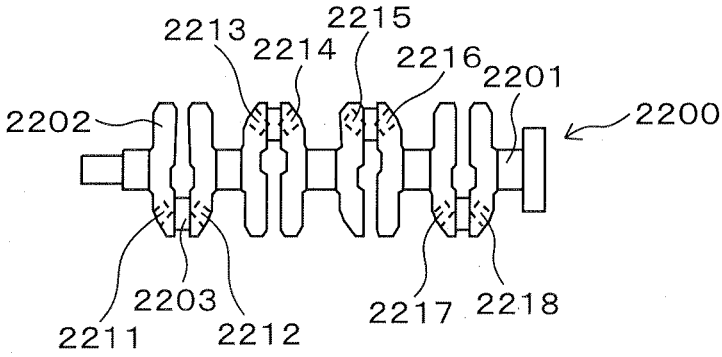
Figure 12:
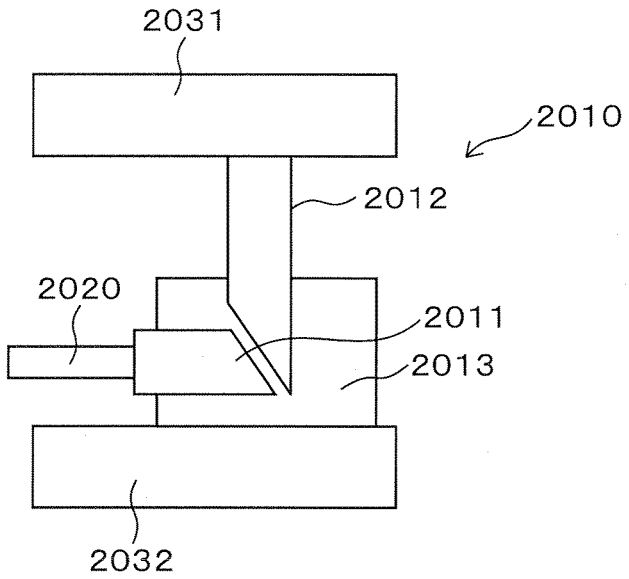
FIG. 12 is a cross-sectional side vie showing a schematic structure of a cam mechanism of a conventional crankshaft production apparatus.
Figure 13:
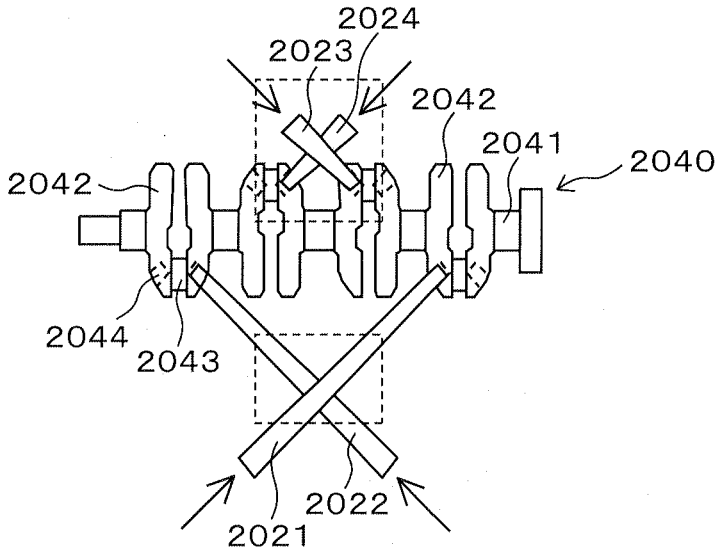
FIG. 13 is a top view showing a structure for an explanation of the problem of the conventional crankshaft production apparatus.

When the press ram reaches the bottom dead point S, the stroke lengths of the cams 2115*c* to 2118*c* become longest, forming the holes 2215 to 2218 by the side-forming punches 2115*p* to 2118*p* is finished. Next, when the cam drives are moved upward according to the upward movement of the press ram 2102, as shown in FIG. 11B, the cams 2115*c* to 2118*c* are evacuated toward the outside of the die set 2103 (the condition of the reference symbol 5B in FIG. 9) by the first evacuating members (in the cam mechanisms 2115 and 2116, reference symbols 2115*s* and 2116*s* in FIG. 8B). After the cams 2115*c* to 2118*c* are moved back to their initial positions (the condition of reference symbol 5C after the point of the reference symbol T in FIG. 9), as shown in FIG. 11C, the crankshaft 2200 in which the holes 2211 to 2218 are formed is removed from the die set by the operation of the ejector pin (the point of reference symbol U in FIG. 9).

In the second embodiment, time-difference forming of the plural holes 2211 to 2218 can be performed in one operation of the press ram 2102 from the top dead point to the bottom dead point by using such a technique for avoiding interference between the punches, so that a load for forming the plural holes 2211 to 2218 can be reduced to about half compared to the case in which the plural holes 2211 to 2218 are simultaneously formed. As a result, reduction in size of the press equipment can be performed. Furthermore, as is explained in the above, the cam mechanisms 2111 to 2118, which can be held in the die set, can be used as a driving source of the side-forming punches 2111*p* to 2118*p*, so that a space for setting an external apparatus such as an actuator for independent control of the side forming punches 2111*p* to 2118*p* is unnecessary. Therefore, further reduction in size of the press equipment can be performed, and workability and productivity can be improved. Furthermore, a moving range of the side-forming punches 2111*p* to 2118*p* can be set in the inside of the die set, so that there is no problem with worker safety.

3. Third Embodiment

3-1. Structure of Third Embodiment

Figure 14:
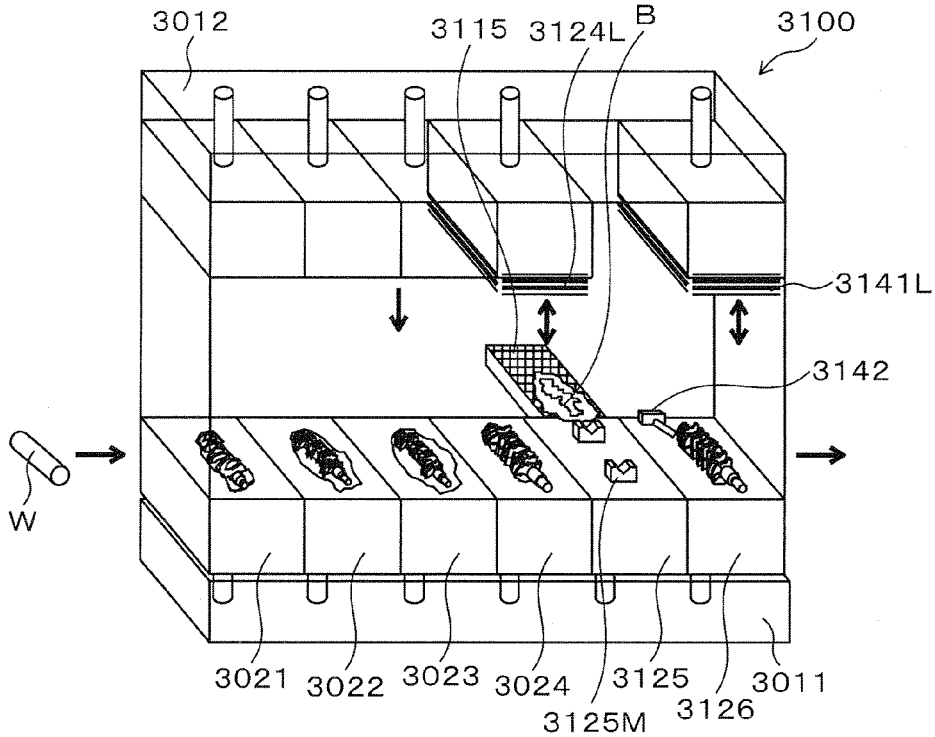
FIG. 14 is a conceptual diagram showing a schematic structure of a crankshaft production apparatus in accordance with an embodiment of a third aspect of the invention.
Figure 15:
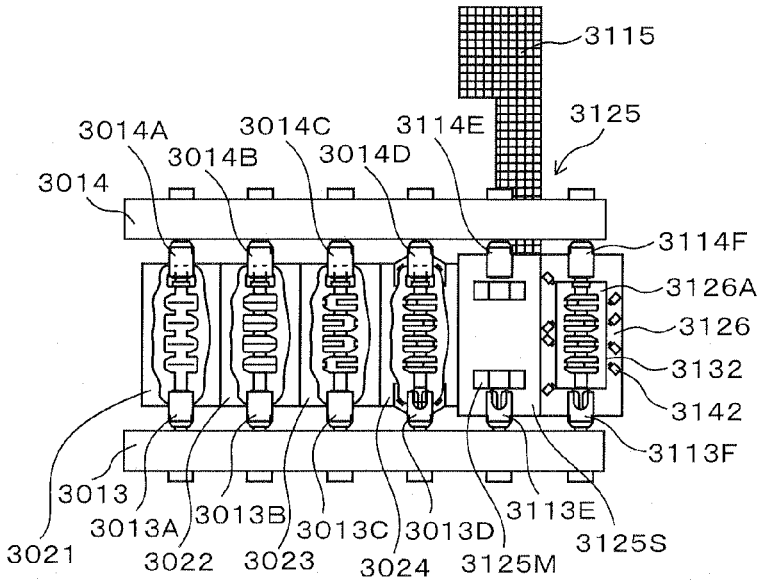
FIG. 15 is a top view showing a partial structure containing feed bars of the crankshaft production apparatus in accordance with the embodiment of the third aspect of the invention.
Figure 16:
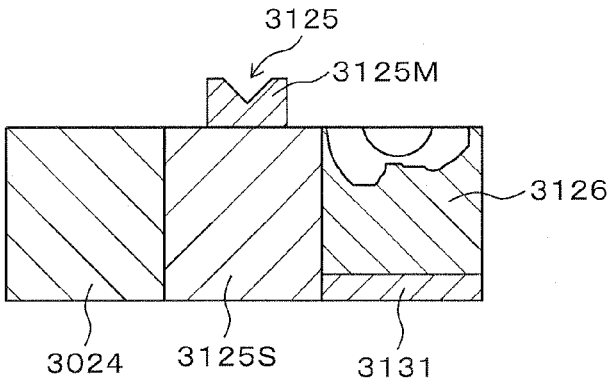
FIG. 16 is a cross-sectional side view showing a schematic partial structure containing a lower die of a hollow forming die set of the crankshaft production apparatus in accordance with the embodiment of the third aspect of the invention.
Figure 17:
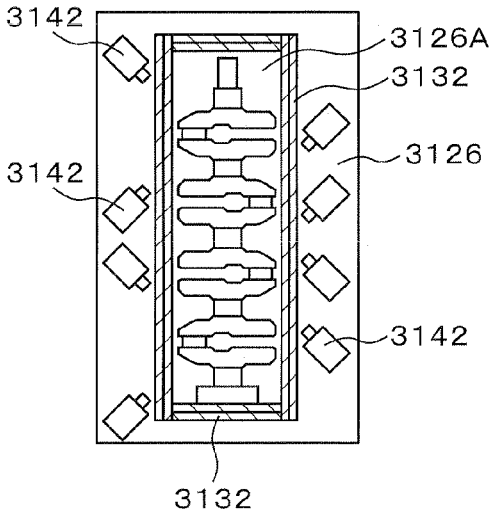
FIG. 17 is a top view showing a schematic structure composed of the lower dies of the hollow forming die set of the crankshaft production apparatus in accordance with the embodiment of the third aspect of the invention.

An embodiment of the third aspect of the invention (a third embodiment) is explained referring to the Figures hereinafter. FIG. 14 is a conceptual diagram showing a schematic structure of a crankshaft production apparatus 3100 in accordance with the third embodiment. FIG. 15 is a schematic top view showing a partial structure containing feed bars 3013 and 3014 of the crankshaft production apparatus 3100 shown in FIG. 14. In FIG. 14, the feed bars 3013 and 3014, clamp clicks 3013A to 3013D, 3113E, 3113F, 3014A to 3014D, 3114E, and 3114F shown in FIG. 15 are not shown in FIG. 14. A liner portion 3131 and a shim 3132 shown in FIGS. 16 and 17 are not shown in FIG. 14. For convenience, only one punch of a hollow forming mechanism 3142 shown in FIG. 15 is shown in FIG. 14. In the Figures for the third embodiment, the same reference symbols as those in FIGS. 20 to 23B indicate the same components as those in FIGS. 20 to 23B, and explanation of the component is omitted.

The crankshaft production apparatus 3100 is an apparatus in which main forming operations (upsetting, rough forging, finishing and trimming operations) performed by the conventional transfer-type press apparatus 3010 shown in FIGS. 20 to 23B, and a hollow forming operation performed by the conventional hollow forming apparatus 3030, are sequentially performed by using the same single press ram 3012 and the fixed-pitch feed bars 3013 and 3014.

In the crankshaft production apparatus 3100, a burr-ejecting portion 3125 and a hollow forming die set 3126 are sequentially provided at the forming progressing direction side (the right-hand side in the Figures) of a trimming die set 3024 of the conventional transfer-type press apparatus 3010. Furthermore, according to newly providing these portions 3125 and 3126, the press ram 3012 and the feed bars 3013 and 3014 are extended toward the forming progressing direction side (the right-hand side in the Figures). The hollow forming portion 3126 is provided with a liner portion 3131 shown in FIG. 16 and a shim 3132 shown in FIG. 17. A burr conveyer 3115 is provided to the burr-ejecting portion 3125 instead of the burr conveyer 3015 of the conventional transfer type press apparatus 3010.

The burr-ejecting portion 3125 is provided with a burr stage 3125S, the burr conveyer 3115 and a robot 3140. The burr stage 3125S is fixed to the press bolster 3011. A disposing portion 3125M on which the burr B and the preformed product P transferred from the trimming die set 3024 are disposed is provided on the upper surface of the burr stage 3125S. The burr conveyer 3115 is disposed at, for example, the rear side of the burr stage 3125S and ejects the burr B toward the outside of the apparatus.

The robot 3140 lifts the burr B on the disposing portion 3125M using a clamp click 3140A and carries the burr B to the burr conveyer 3115. A method for carrying the burr B to the burr conveyer 3115 is not restricted by the robot 3140 but may be applied with modifications of the carrying methods. For example, a moving mechanism by which the burr conveyer 3115 is approached with respect to the burr stage 3125S may be provided to the structure so that the burr B on the disposing portion 3125M can be removed therefrom by the burr conveyer 3115.

The hollow forming die set 3126 is a vertically separatable type of die set. A lower die of the hollow forming die set 3126 is fixed to a press bolster 3011 and an upper die is fixed to the press ram 3012. The hollow forming die set 3126 is provided with a hollow forming mechanism 3142 and a work holding cushion 3041L having the same structures as the hollow forming mechanism 3042 and the work holding cushion 3141L shown in FIG. 20.

In the lower die of the hollow forming die set 3126, as shown in FIG. 16, a liner portion 3131 for adjusting a height position of the hollow forming die set 3126 is provided. For example, when the height position of the lower die of the hollow forming die set 3126 is low, the liner portion 3131 is disposed below the bottom of the lower die. As the liner portion 3131, a plate material having the thickness of which a dimension is equivalent to, for example, a preferable amount of the height adjustment for the lower die is used. In this case, the plural plate materials may be used and are appropriately inserted and removed according to the amount of the height adjustment. The liner portion 3131 is also provided to the upper die as necessary.

In the lower die of the hollow forming die set 3126, as shown in FIG. 17, the shim 3132 for adjusting the position in the horizontal direction of the hollow forming die set 3126 is provided. The shim 3132 is a plate material disposed on, for example, the circumference of a shaping die portion 3126A of the lower die. The shim 3132 is inserted and removed from at least one of the directions of the front side (the lower side in FIG. 17), the rear side (the upper side in FIG. 17), the forming progressing direction side (the right-hand side in FIG. 17) and the side opposite to the forming progressing direction (the left-hand side in FIG. 17) of the circumference of the forming die portion 3126A according to, for example, the amount and the direction of the horizontal position of the shaping die portion 3126A. The shim 3132 is also provided to the upper die and is correspondingly positioned with respect to the shim 3132 of the lower die.

A first feed bar 3013 is provided with first clamp clicks 3113E and 3113F and a second feed bar 3014 is provided with second clamp clicks 3114E and 3114F. The clamp clicks 3113E and 3114E are disposed facing the burr stage 3125S and the clamp clicks 3113F and 3114F are disposed facing the hollow forming die set 3126. The works W are held by the first clamp clicks 3113E and 3113F and the second clamping clicks 3114E and 3114F and are moved by first and second feed bars along the extending direction thereof.

3-2. Movement of Third Embodiment

Movement of the crankshaft production apparatus 3100 is explained with principal reference to FIGS. 19A to 19D. FIGS. 19A to 19D are conceptual diagrams showing sequentially forming operations performed by the crankshaft production apparatus 3100.

In the crankshaft production apparatus 3100, as shown in FIGS. 19A to 19D, from the viewpoints of load and cooling in the forming press work, die-set clamping, die-set opening and transferring the works W to the die sets of the next operations, die set clamping, die set opening are sequentially performed in a condition in which the works W1, W2 and W3 are disposed therein with an interval of one operation. In this case, upsetting, rough forging, finishing, trimming and hollow forming operation are performed by single press ram 3012, and the works W1 and W2 are transferred by a pair of feed bars 3013 and 3014.

Figure 19A:
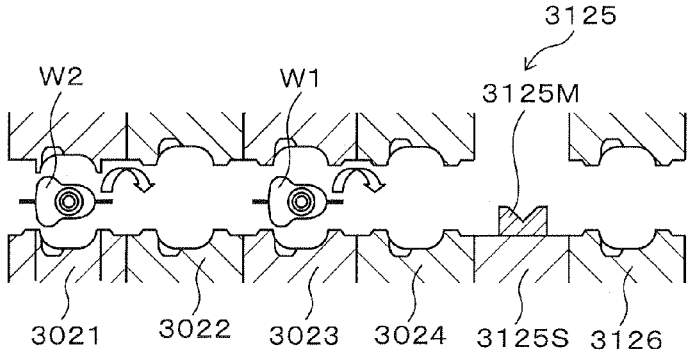
FIGS. 19A to 19D are conceptual diagrams showing sequential forming operations by the crankshaft production apparatus in accordance with the embodiment of the third aspect of the invention.
Figure 19B:
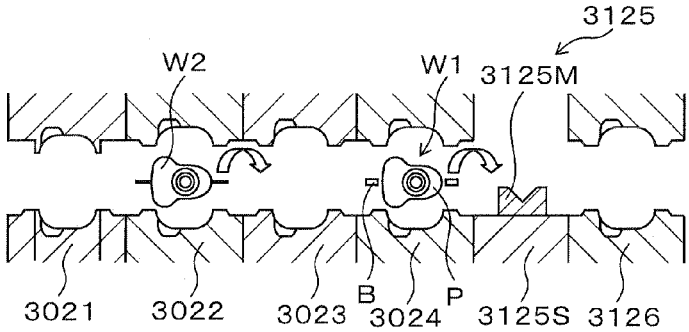

For example, as shown in FIG. 19A, the work W1 of which a finishing operation is completed in a finishing die set 3023 is held by the clamp clicks 3013C and 3014C (shown only in FIG. 15) after an upward movement of the press ram 3012 and is transferred to a trimming die set 3024 by the feed bars 3013 and 3014 (shown only in FIG. 15). At the same time, the work W2 of which a upsetting operation is completed in a upsetting die set 3021 is held by the clamp clicks 3013A and 3014A (shown only in FIG. 15) and is transferred to an rough forging die set 3022 by the feed bars 3013 and 3014.

Figure 23A:
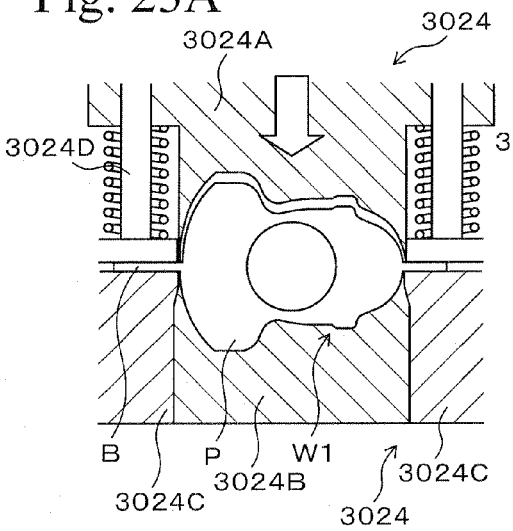
FIGS. 23A and 23B are cross-sectional side views showing movements of a trimming die set of the conventional crankshaft production apparatus.

Next, in the trimming die set 3024, as shown in FIG. 23A, the trimming operation with respect to the work W1 is performed by the downward movement of the press ram 3012. Specifically, the burr B is punched out from the work W1, so that the preformed product P can be obtained. At the same time, in the rough forging die set 3022, the rough forging operation with respect to the work W2 is performed by the downward movement of the press ram 3012.

Figure 23B:
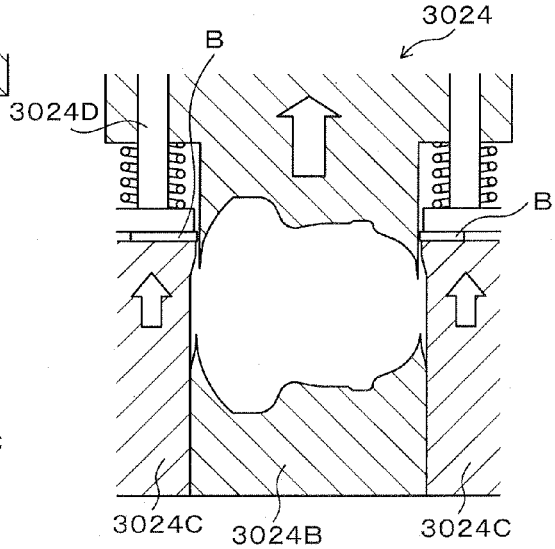

Next, after the upward movement of the press ram 3012, as shown in FIG. 23B, the preformed product P in the trimming die set 3024 is held by the clamp clicks 3013D and 3014D (shown only in FIG. 15) and is transferred to the burr ejecting portion 3125 by the feed bars 3013 and 3014, so that the preformed product P is disposed on the disposing portion 3125M. In this case, the burr B is remained in the trimming die set 3024. At the same tine, the work W2 in the rough forging die set 3022 is held by the clamp clicks 3013B and 3014B (shown only in FIG. 15) and is transferred to the finishing die set 3023 by the feed bars 3013 and 3014.

Figure 19C:
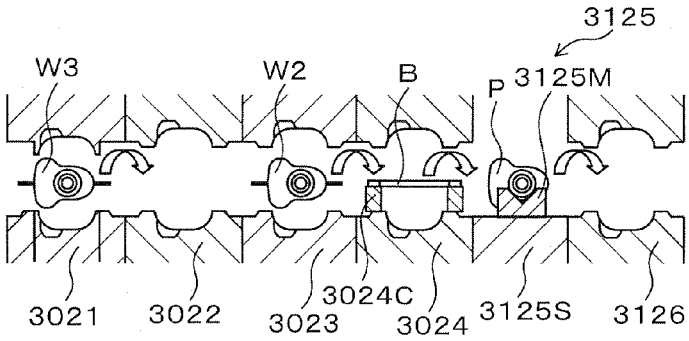

Next, the finishing operation with respect to the work W2 is performed in the finishing die set 3023, after the upward movement of the press ram 3012, as shown in FIG. 19C, the preformed product P is held by the clamp clicks 3113E and 3114E in the burr ejecting portion 3125 and is transferred to a hollow forming die set 3126 by the feed bars 3013 and 3014.

In the third embodiment, the hollow forming die set 3126 is provided with a shim 3132 for adjusting the position in the horizontal direction thereof, so that the position in the horizontal direction of the hollow forming die set 3126 can be adjusted by the shim 3132 according to a loading position of the preformed product P into the hollow forming die set 3126. Therefore, when the clearance between the surface of the cavity of the hollow forming die set 3126 and the preformed product P is very slight, the preformed product P can be easily inserted into the cavity of the hollow forming die set 3126. Furthermore, such an adjustment in the horizontal direction can be individually performed from the die sets 3021 to 3024 and the burr stage 3125A, so that the adjustment does not affect each operation in the die sets 3021 to 3024 and burr stage 3125A.

In such a transfer of the preformed product P, in the trimming die set 3024, a burr holding die set 3024C is upwardly moved from the lower die thereof according to the upward movement of the press ram 3012, so that the burr B remaining in the trimming die set 3024 is lifted. The burr B is held by the clamp clicks 3013D and 3014D and is transferred to the burr ejecting portion 3125 so as to be disposed on the burr disposing portion 3125M. At the same time, the work W2 in the finishing die set 3023 is held by the clamp clicks 3013C and 3014C and is transferred to the trimming die set 3024.

Next, in the hollow forming die set 3126, the upper die thereof is moved downward by the press ram 3012 toward the lower die on which the preformed product P is disposed. By this operation, the preformed product P is not only closed in the die set 3126 but also inserted by the punch of the hollow forming mechanism, so that the preformed product P in which the hole H is formed can be obtained. At the same time, in the trimming die set 3024, the trimming operation with respect to the work W2 is performed and the burr B is punched out from the work W2 by the downward movement of the press ram 3012, so that the preformed product P of the crankshaft can be obtained.

In the third embodiment, the hollow forming die set 3126 is provided with a liner portion 3131 for adjusting the position in the height direction, so that adjusting a thickness (adjusting in the height direction) of the hole H required in forming the hole H in the hollow forming die set 3126 can be performed by adjusting the height of the hollow forming die set 3126 by the liner portion 3131. Such a height adjustment can be individually performed from the die sets 3021 to 3024, so that the height adjustment does not affect each forming operation in the die sets 3021 to 3024.

Figure 18:
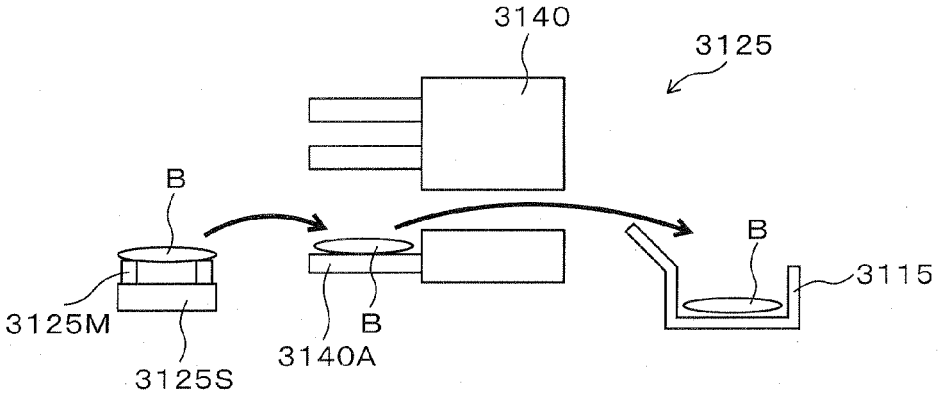
FIG. 18 is a conceptual diagram showing a schematic structure of a burr-ejecting portion of the crankshaft production apparatus in accordance with the embodiment of the third aspect of the invention.
Figure 19D:
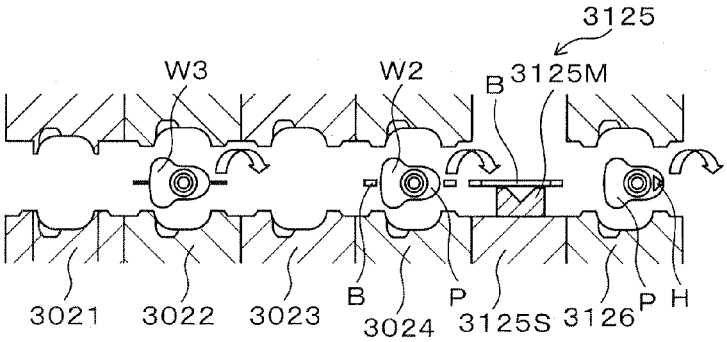
Figure 20:
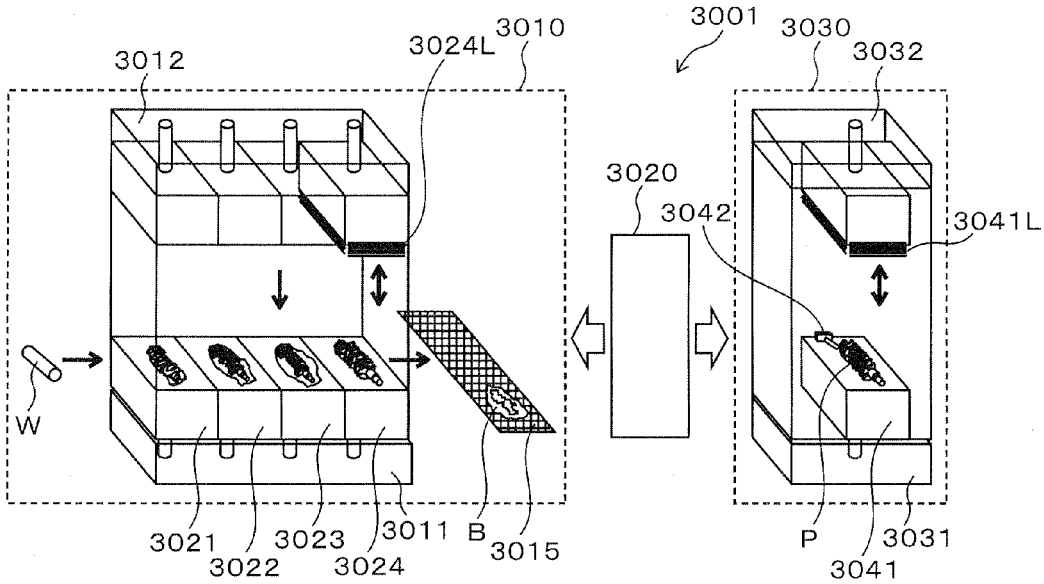
FIG. 20 is a conceptual diagram showing a schematic structure of a conventional crankshaft production apparatus.
Figure 21:
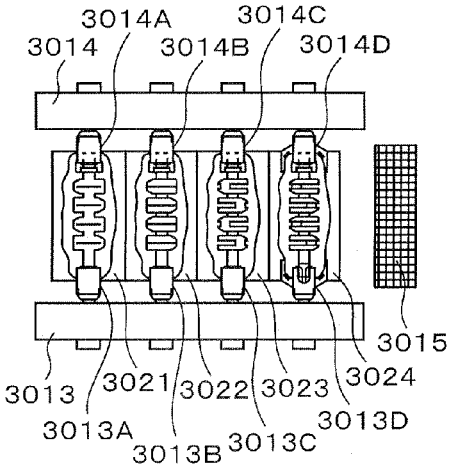
FIG. 21 is a schematic top view showing a partial structure containing feed bars of the conventional crankshaft production apparatus.
Figure 22A:
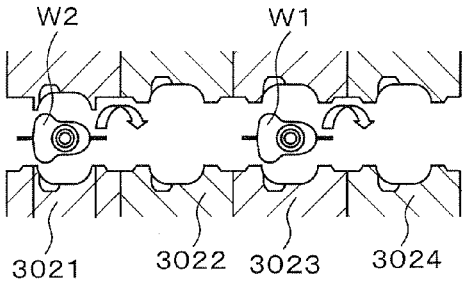
FIGS. 22A to 22C are conceptual diagrams showing forming operations by a transfer type press machine of the conventional crankshaft production apparatus.
Figure 22B:
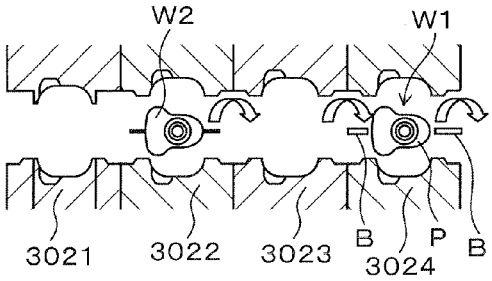
Figure 22C:
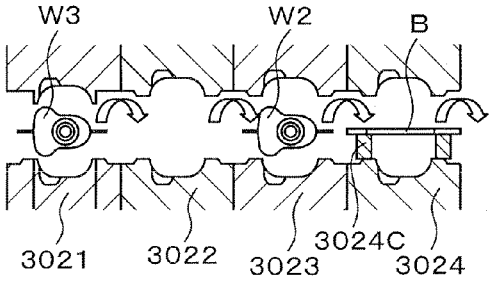

Next, after the upward movement of the press ram 3012, as shown in FIG. 19D, the preformed product P in the hollow forming die set 3126 is held by the clamp clicks 3113F and 3114F (shown only in FIG. 15) and is transferred to the outside of the apparatus by the feed bars 3013 and 3014. At the same time, the burr B in the burr-ejecting portion 3125 is ejected to the burr conveyer 3115 by a click 3140A of a robot 3140 shown in FIG. 18. Furthermore, the preformed product P formed from the work W2 in the trimming die set 3024 is held by the clamp clicks 3013D and 3014D and is transferred to the burr ejecting portion 3125 by the feed bars 3013 and 3014, so that the preformed product P is disposed on the disposing portion 3125M. In this case, the burr B obtained by processing with respect to the work W2 is remained in the trimming die set 3024.

After the processing shown in FIG. 19D, the work W2 is processed in the same way as the processing with respect to the work W1, and the work W3 loaded into the apparatus with an interval of one operation with respect to the work W2 is processed in the same way as the processing with respect to the works W1 and W2, so that the formed products of the crankshafts can be sequentially obtained.

In the third embodiment, the horizontal position of the hollow forming die set 3126 can be adjusted by the shim 3132, so that the preformed product can be easily inserted into the cavity of the hollow forming die set 3126. Furthermore, the horizontal adjustment by the shim 3132 does not affect each operation in the die sets 3021 to 3024 and the burr stage 3125, so that the works (the material of the crankshaft, the preformed product and the formed product of the crankshafts) can be transferred by a pair of feed bar 3013 and 3014 of which the pitches are fixed. Furthermore, the height adjustment of the hollow forming die set 3126 by the liner portion 3131 can be performed without effecting each operation in the die sets 3021 to 3024, so that the upper dies of the die sets 3021 to 3024 and 3126 can be moving downward toward the lower dies thereof by single press ram 3012 and the selectivity of the shape of the material loaded into the hollow forming die set 3126 can be improved.

As is explained above, each forming operation can be sequentially performed by the feed bars 3013 and 3014 of which the pitches are fixed and single press ram 3012 in single apparatus 3100, so that production cost can be reduced and selectivity of the layout of the apparatus can be upgraded.

In particular, in the burr ejecting portion 3125 provided at a position between the trimming die set 3024 and the hollow forming die set 3126, the burr B can be ejected toward a direction different from the direction from the burr conveyer 3115 to the hollow forming die set 3126. In this case, the clamp clicks 3113E and 3114E are additionally provided to the feed bars 3013 and 3014 and are disposed at the positions thereon corresponding to the burr ejecting portion 3125, so that not only the transfer of the works, but also the transfer of the burr B to the burr stage 3125S of the burr ejecting portion 3125, can be performed by the feed bars 3013 and 3014. Therefore, modification of the specifications such as an interval length between the clamp clicks is unnecessary.

Examples

Figure 3:
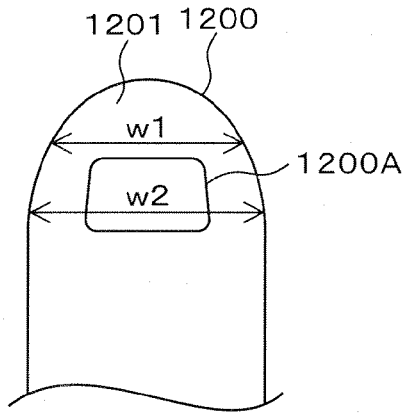
FIG. 3 is a diagram for an explanation of dimensions on a surface on which a hole is formed in an experimental example and a comparative experimental example.

The first embodiment is explained in detail with reference to specific examples. In the experimental example and the comparative experimental example in accordance with the first embodiment, as shown in FIG. 3, a hole 1200A was formed in a material 1200 by inserting a punch thereinto. FIG. 3 is a top view of the material 1200. In the material 1200, after forming the hole 1200A, a required dimension of a width w1 was set at 70.1 mm, and that of a width w2 was set at 50.2 mm.

In the experimental example of the first embodiment, a method for producing the crankshaft of the first embodiment shown in FIG. 2 was used. Specifically, the material 1200 having a shape smaller than a final shape thereof was disposed in the die set. A shape of an inner surface of the die set was matched with a required shape of the material 1200. The hole 1200A was formed in the material 1200 by inserting the punch thereinto. As a result, in the material 1200 after forming the hole 1200A, the dimension of the width w1 was 70.8 mm (the difference from the required value was 0.7 mm) and the dimension of the width w2 was 50.4 mm (the difference from the required value was 0.2 mm). The surface shrinkage (the reduction of the height of the end surface 1201 in the vertical direction on a plane of paper) of the end surface 1201 in the vicinity of the hole 1200A of the material 1200 was 0.1 mm.

Figure 4:
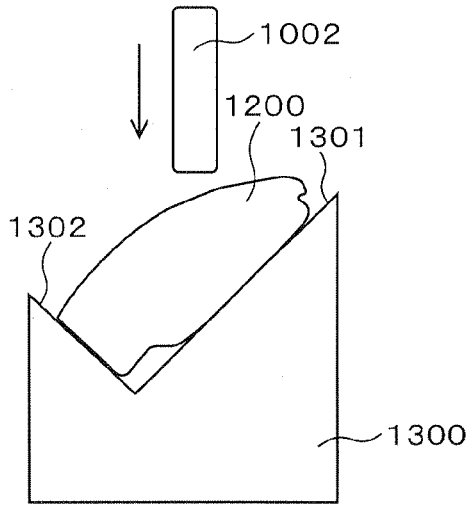
FIG. 4 is a diagram for an explanation of a method for forming the hole in the comparative experimental example.
Figure 5:
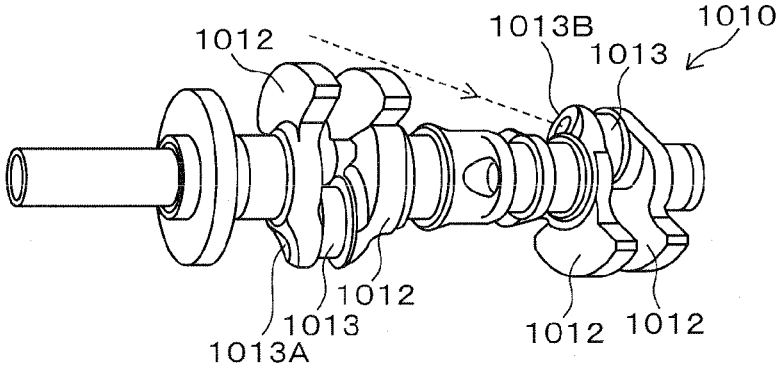
FIG. 5 is a diagram for an explanation of a conventional method for forming the hole at a crankpin.
Figure 6A:
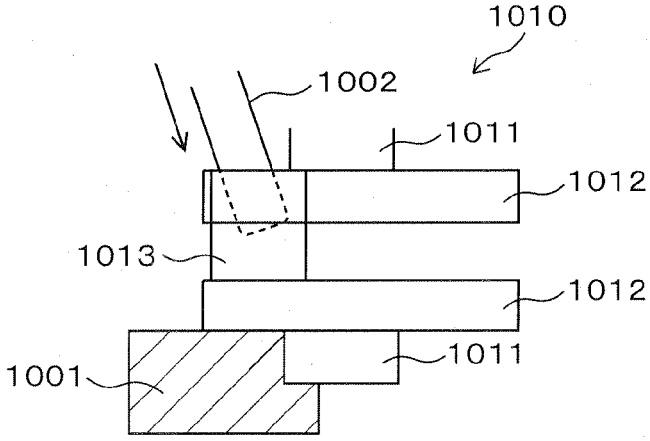
FIGS. 6A and 6B are diagrams for explanations of problems of the conventional method for forming the hole in the crankpin.
Figure 6B:
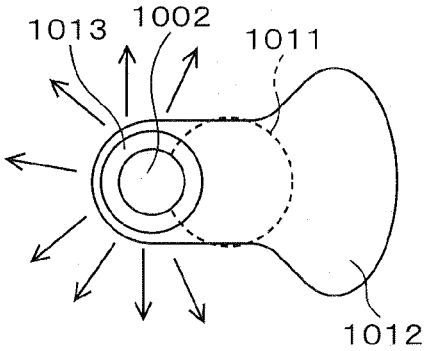

In the comparative experimental examples, as shown in FIG. 4, a material 1200 was disposed on an inclined surface 1301 of a lower die 1300 and the hole 1200A was formed on the material 1200 by inserting a punch 1002 thereinto. When the punch 1002 was inserted, the material 1200 was depressed by inclined surfaces 1301 and 1302, but the other portions except for the depressed portions were not restricted. As a result, in the material 1200 after forming the hole 1200A, the dimension of the width w1 was 75.4 mm (the difference from the required value was 5.3 mm) and the dimension of the width w2 was 51.3 mm (the difference from the required value was 1.1 mm). The surface shrinkage of the end surface 1201 in the vicinity of the hole 1200A of the material 1200 was 2.0 mm.

As is explained above, in the experimental example of the first embodiment, the width W1, the width W2 and the surface shrinkage thereof were smaller than those of the comparative experimental example. Therefore, in the method for producing the crankshaft of the first aspect of the invention, when the hole is formed, dimensional accuracy of the portion in the vicinity of the hole can be improved and surface shrinkage can be avoided.

What is claimed is:

1. A method for producing a crankshaft, comprising:

preforming the crankshaft provided with a crankpin;

forging the preformed product disposed in a cavity of a separatable die set composed of an upper die and a lower die;

wherein a shape of the preformed product of the crankshaft is formed to be smaller than a shape of the cavity in the preforming, a hollow hole is formed in the crankpin by inserting a punch into the crankpin into the separatable die set, thereby filling the cavity with a material of the preformed product.

2. The method for producing the crankshaft according to claim 1, wherein the upper die is moved in a direction to which the upper die is opened according to forming pressure in the cavity.

3. A crankshaft production apparatus comprising:

a die set having a lower die, an upper die movably arranged with respect to the lower die, and at least two side-forming punches perpendicularly movable with respect to a moving direction of the upper die;

a press ram for closing and forming a material of the crankshaft in the die set by moving the upper die with respect to the lower die;

a cam mechanism equipped to each side-forming punch for moving the side-forming punches toward an inside of the die set in conjunction with the movement of the press ram;

an evacuating mechanism equipped to at least one of the side-forming punches for avoiding interference between the side forming punches and for canceling engagement between the movements of the press ram and a side-forming punch via the cam mechanism.

4. A method for producing a crankshaft, comprising:

providing a die set having a lower die, an upper die movably arranged with respect to the lower die, and at least two side-forming punches perpendicularly movable with respect to a moving direction of the upper die;

forming a material of the crankshaft closed in the die set by a movement of a press ram, and forming holes in predetermined positions of the material by movement of each side-forming punch via a cam mechanism toward an inside of the die set in conjunction with the movement of a press ram;

wherein the material having a structure causing intersection of the side-forming punches with each other is used in forming the hole in the material by the side-forming punches and one side-forming punch is evacuated by the evacuating mechanism for canceling engagement between the movement the press ram and the one side-forming punch and for avoiding interference between the side-forming punches with each other after forming the holes, and another side forming punch is moved toward the inside of the die set.

5. A crankshaft production apparatus comprising:

a first vertically separatable die set composed of an upper die and a lower die for preforming a material of a crankshaft;

a second vertically separatable die set composed of an upper die and a lower die closing the preformed product obtained by the first vertically separatable die set therein and forming a hollow hole by inserting a punch into a predetermined portion of the preformed product;

a press ram closing the first vertically separatable die set and the second vertically separatable die set by the movement of the upper dies of the first vertically separatable die set and the second vertically separatable die set toward the lower dies thereof;

a shim provided to the second vertically separatable die set for adjusting a position in a horizontal direction thereof;

a liner portion provided to the second vertically separatable die set for adjusting a position in a height direction thereof.

6. A crankshaft production apparatus according to claim 5, wherein a burr-ejecting portion is provided for ejecting a burr formed in forming the preformed product by the first separatable die set toward the outside, and the burr ejecting portion is provided with a burr stage provided at a position between the first separatable die set and the second separatable die set and a burr-ejecting portion provided in a direction different from the direction of from the burr stage toward the second separatable die set.

7. A method for producing a crankshaft, comprising:

preforming a material of the crankshaft closing the material in a first separatable die set;

forming a hole by closing a preformed product in a second separatable die set and inserting a punch provided to the second separatable die set into a predetermined portion of the preformed product;

wherein a first vertically separatable die set and a second vertically separatable die set are closed by moving the upper dies of the first separatable die set and second separatable die set toward the lower dies thereof by a press ram;

a position in a horizontal direction of the second separatable die set is adjusted by a shim and a position in a height direction of the second separatable die set is adjusted by a liner portion.

* * * * *